US008511001B2

(12) United States Patent
Uffner et al.

(10) Patent No.: US 8,511,001 B2
(45) Date of Patent: Aug. 20, 2013

(54) SLIDE TOP SHED

(75) Inventors: Michael Uffner, Naperville, IL (US); Michael R. Vogler, Oswego, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 120 days.

(21) Appl. No.: 13/174,887

(22) Filed: Jul. 1, 2011

(65) Prior Publication Data

US 2013/0000218 A1 Jan. 3, 2013

(51) Int. Cl.
*E04B 1/346* (2006.01)

(52) U.S. Cl.
USPC ..... 52/66; 52/64; 52/67; 52/71; 52/72

(58) Field of Classification Search
USPC ..... 52/66, 64, 2.17, 67, 71, 72
See application file for complete search history.

(56) References Cited

U.S. PATENT DOCUMENTS

| | | | | |
|---|---|---|---|---|
| 1,936,571 | A | 10/1932 | Bumann | |
| 3,866,381 | A | 2/1975 | Eschbach et al. | |
| 4,557,091 | A | 12/1985 | Auer | |
| 4,570,392 | A | 2/1986 | Oltman et al. | |
| 4,986,037 | A | 1/1991 | Jackson, Jr. | |
| 5,036,634 | A | 8/1991 | Lessard et al. | |
| 5,167,341 | A | 12/1992 | Morton et al. | |
| D371,208 | S | 6/1996 | De Zen | |
| 5,544,870 | A | 8/1996 | Kelley et al. | |
| 5,619,826 | A | 4/1997 | Wu | |
| 5,682,622 | A | 11/1997 | Tagg | |
| 5,706,613 | A | 1/1998 | Drake, Jr. et al. | |
| 5,778,604 | A * | 7/1998 | Snow | 52/66 |
| 6,099,092 | A | 8/2000 | Uffner et al. | |
| 6,115,971 | A | 9/2000 | Loebertmann et al. | |
| 6,145,254 | A | 11/2000 | Silva | |
| 6,250,022 | B1 | 6/2001 | Paz et al. | |
| 6,418,672 | B1 | 7/2002 | Hampel | |
| 6,581,337 | B1 | 6/2003 | Skov et al. | |
| 6,604,328 | B1 | 8/2003 | Paddock | |
| 6,701,678 | B1 | 3/2004 | Skov et al. | |
| 6,796,087 | B1 | 9/2004 | Greene | |
| 6,892,497 | B2 | 5/2005 | Moon et al. | |
| 7,543,411 | B2 * | 6/2009 | Whitehead et al. | 52/66 |
| 7,581,357 | B2 * | 9/2009 | Richardson et al. | 52/79.5 |
| 7,877,936 | B2 * | 2/2011 | Uffner et al. | 52/90.1 |
| 2003/0000154 | A1 | 1/2003 | Ignazio | |
| 2003/0014927 | A1 | 1/2003 | Brooks | |
| 2003/0140573 | A1 * | 7/2003 | Marcinkowski et al. | 52/79.5 |
| 2004/0187402 | A1 * | 9/2004 | Moon et al. | 52/79.5 |
| 2005/0120641 | A1 * | 6/2005 | Whitehead et al. | 52/79.1 |
| 2005/0223652 | A1 | 10/2005 | Mower et al. | |
| 2007/0044391 | A1 * | 3/2007 | Richardson et al. | 52/79.1 |
| 2007/0175108 | A1 * | 8/2007 | Stein et al. | 52/79.5 |

* cited by examiner

*Primary Examiner* — Mark Wendell
(74) *Attorney, Agent, or Firm* — McHale & Slavin, P.A.

(57) ABSTRACT

The present invention provides a system or kit which includes plastic components which can be readily assembled to form a structure with the use of a minimal number of tools. The components are precut so that measurements and cutting of the component materials is eliminated. This leads to a savings in wasted materials. The components are readily assembled using conventional fasteners and simple hand tools. The components have preformed notches and tabs in order to facilitate assembly of the components without the requirement for measurements. This assures that the components will be assembled correctly and eliminates the opportunity for inaccurate measurements and incorrect assembly. The enclosure is provided with a sliding roof panel and pivoting doors which permit easy access to the interior of the enclosure.

15 Claims, 38 Drawing Sheets

SLIDE TOP SHED

CROSS REFERENCE TO RELATED APPLICATIONS

This application is related to U.S. Pat. No. 7,543,411, issued Jun. 9, 2009, entitled "LOW PROFILE PLASTIC PANEL ENCLOSURE" and to U.S. patent application Ser. No. 12/942,679, filed Nov. 9, 2010, entitled "COMBO WOOD AND PLASTIC MODULAR STORAGE SHED", the entireties of which are incorporated herein by reference.

FIELD OF THE INVENTION

This invention relates generally to enclosures, such as utility or garden sheds, constructed of plastic materials. More specifically, the present invention relates to an enclosure having walls, a roof, doors and a floor made from blow molded plastic materials.

BACKGROUND OF THE INVENTION

Utility sheds are a necessity for lawn and garden maintenance, as well as general all-around home storage space. Typically, items such as lawn mowers, garden tillers, snow blowers, wheel barrows, shovels, rakes, brooms and the like consume a great deal of floor space in a garage. This results in the homeowner parking his/her vehicles outside of the garage.

The prior art has proposed a number of different storage buildings or utility sheds assembled from a kit which include a plurality of blow molded or extruded plastic panels and connectors. These kits are readily assembled by a homeowner to form storage structures or utility sheds of various sizes. These structures are generally suitable for the storage of hand tools and smaller lawn equipment. Typically, these kits require extruded metal or plastic connector members having a specific cross-sectional geometry which facilitates an engagement between the connector members and one or more of the blow molded plastic panels having a complimentary edge configuration.

A particularly common structure for the connector members is the I-beam cross section. The I-beam defines free edge portions of the connector member which fit within approximately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel, and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process, the conduits are difficult to extrude in long sections for structural panels. Thus, the panels require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length. The protrusions are situated to slidably engage the conduits located in the side panel sections to create the height required for utility shed walls.

The aforementioned systems can also incorporate roof and floor panels to form a freestanding enclosed structure such as a utility shed. U.S. Pat. Nos. 3,866,381; 5,036,634; and 4,557,091 disclose various systems having inter-fitting panel and connector components. Such prior art systems, while working well, have not met all of the needs of consumers to provide the structural integrity required to construct larger sized structures. Larger structures must perform differently than smaller structures. Larger structures require constant ventilation in order to control moisture within the structure. Large structures must also withstand larger wind and snow loads compared to smaller structures. Paramount to achieving these needs is a panel system which eliminates the need for extruded connectors to create enclosure walls which resist panel separation, buckling and racking, and a roof system which allows ventilation while preventing weather infiltration. A further problem is that the walls formed by the panels must tie into the roof and floor in such a way as to unify the entire structure. Also, from a structural standpoint, the structure should include components capable of withstanding the increased wind, snow and storage loads required by larger structures. From a convenience standpoint, a door must be present which can be readily installed after assembly of the wall and roof components. The door must also be comparable with the side walls and provide ready access to the interior of the structure. Also from a convenience standpoint, the structure should permit natural as well as artificial lighting. The structure should be aesthetically pleasing in appearance to blend in with the surrounding structures.

There are also commercial considerations that must be satisfied by any viable structure assembly system or kit; considerations which are not entirely satisfied by the state of the art products. The structure must be formed from relatively few components which are inexpensive to manufacture by conventional techniques. The enclosure must also be capable of being packaged and shipped in a knock-down state. In addition, the system or kit must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using integrally formed connectors requiring minimal hardware and tools. Further, the system must not require excessive strength to assemble or include heavy component parts. Moreover, the system must assemble together in such a way so as not to detract from the internal storage volume of the resulting enclosure, or otherwise negatively affect the utility of the structure.

SUMMARY OF THE INVENTION

The present invention provides a system or kit which includes plastic components which can be readily assembled to form a structure with the use of a minimal number of tools. The components are precut so that measurements and cutting of the component materials are eliminated. This leads to a savings in wasted materials. The components are readily assembled using conventional fasteners and simple hand tools. The components have preformed notches and tabs in order to facilitate assembly of the components without the requirement for measurements. This assures that the components will be assembled correctly and eliminates the opportunity for inaccurate measurements and incorrect assembly. The enclosure is provided with a sliding roof panel and pivoting doors which permit easy access to the interior of the enclosure.

Accordingly, it is an objective of the present invention to provide a system or kit for assembly of a utility enclosure which utilizes preformed plastic panels that permit ease of assembly of the utility enclosure.

It is a further objective of the present invention to provide a utility enclosure system or kit which includes a sliding roof panel and pivoting doors that permit easy access to the interior of the enclosure.

It is yet another objective of the present invention to provide a utility enclosure system or kit wherein the panel members include integrated connectors which accommodate plastic formation of the panel components for increased structural integrity.

It is a still further objective of the present invention to provide a utility enclosure system or kit which utilizes structural corner assemblies for increased enclosure rigidity.

It is still another objective of the instant invention to provide a utility enclosure system or kit which utilizes interlocking bosses and pockets to secure wall panels to a floor.

It is still another objective of the instant invention to provide a utility enclosure system or kit which utilizes floor components which interlock together for structural stability and the prevention of incursion of water into the enclosure.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
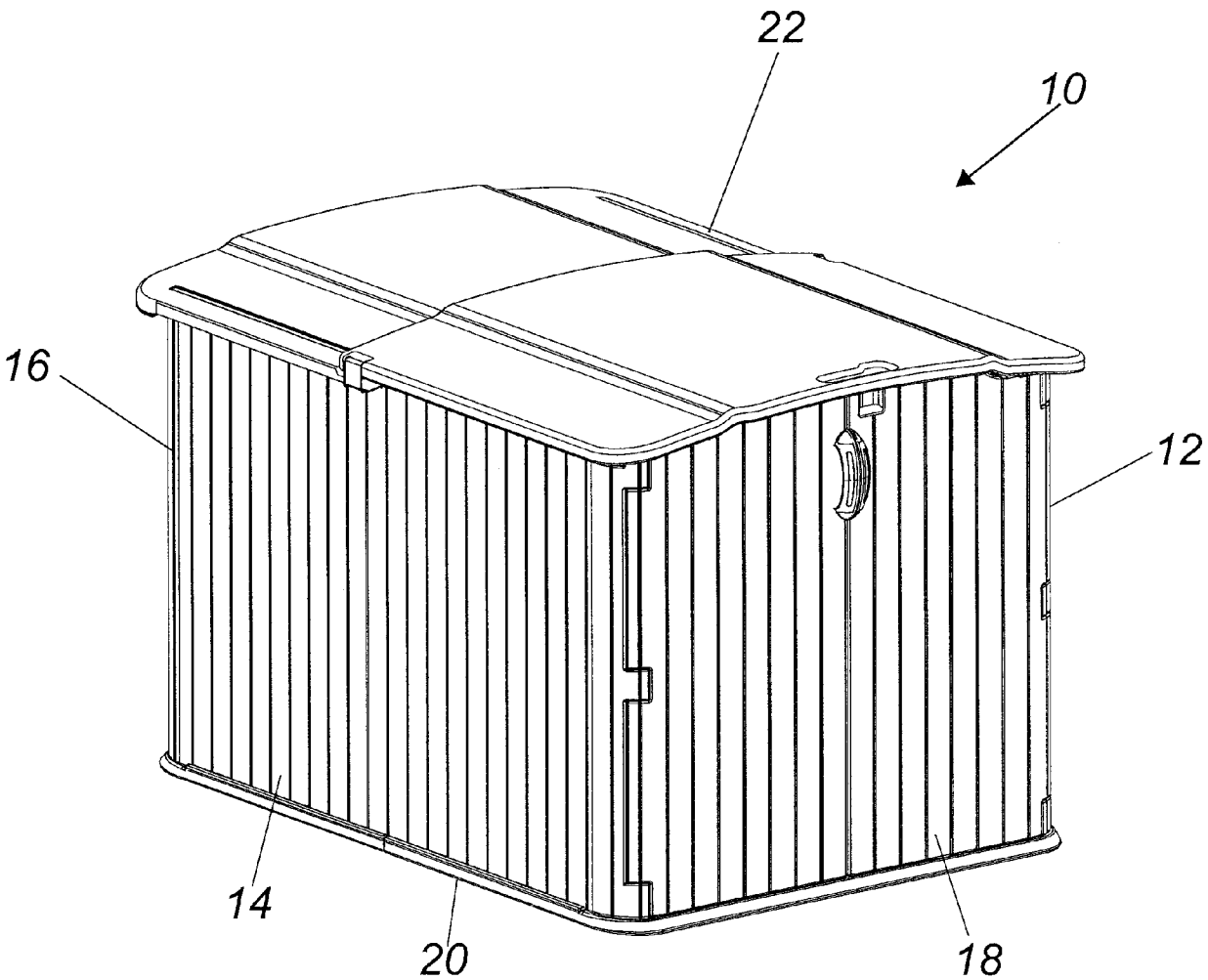
FIG. 1 is a front perspective view of the present invention.
Figure 2:
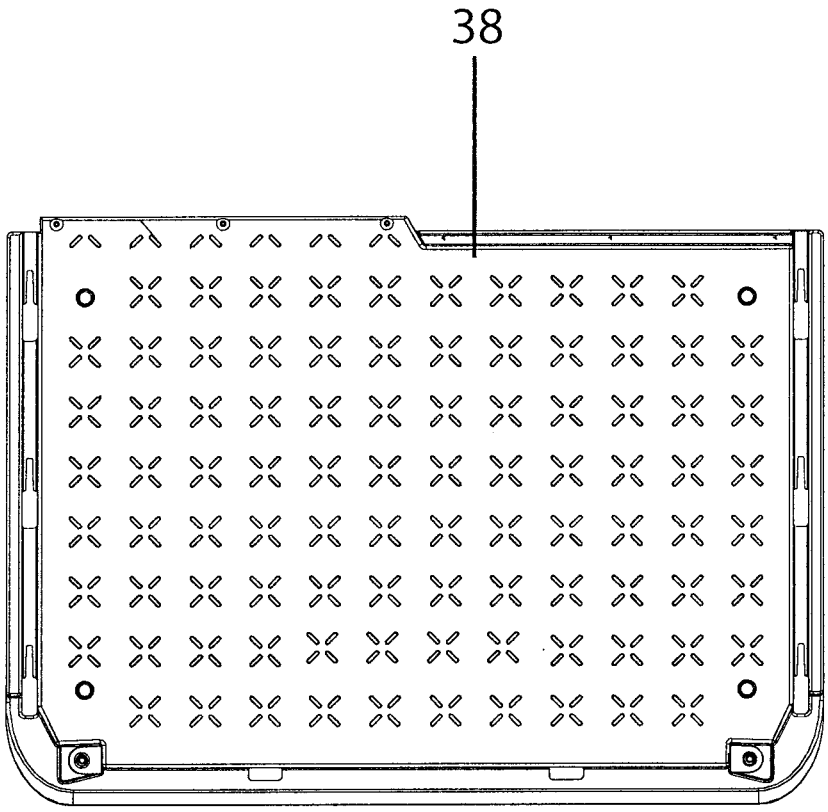
FIG. 2 is one of the floor panels.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 3:
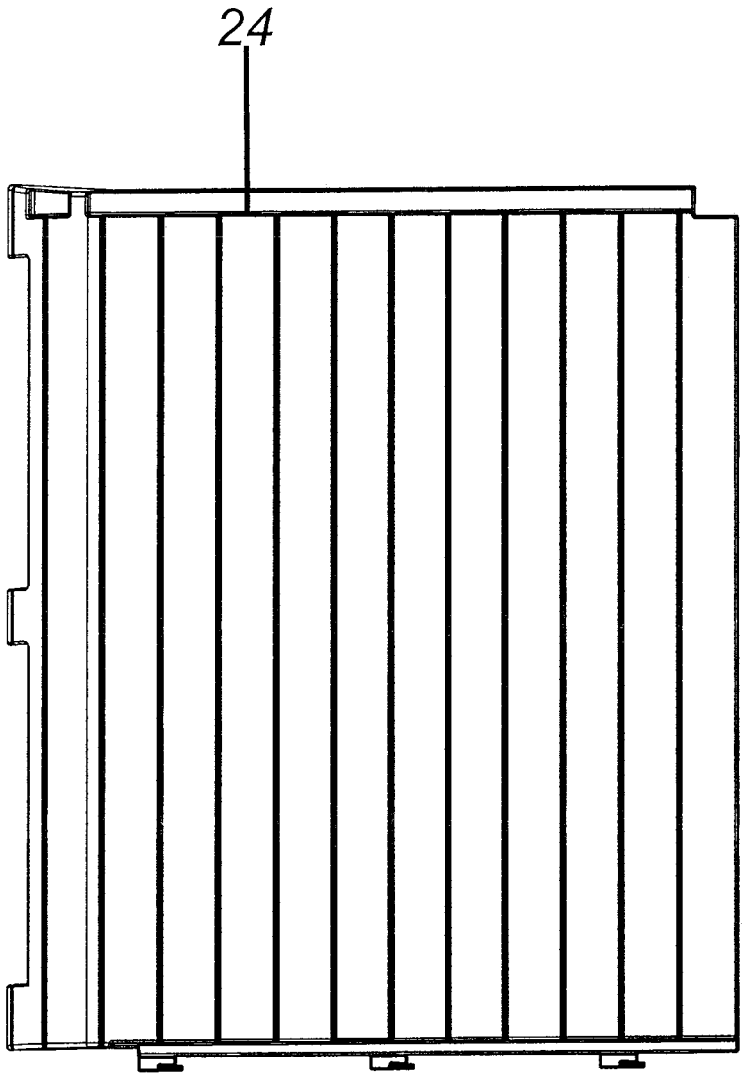
FIG. 3 is a right wall side front panel.
Figure 4:
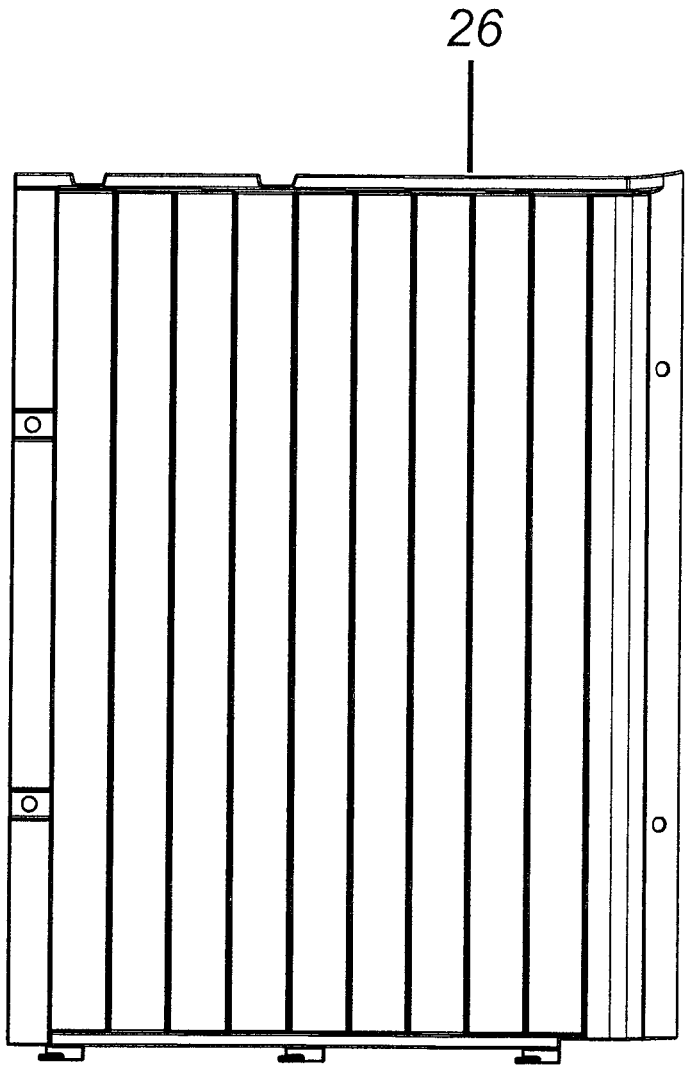
FIG. 4 is a right wall side rear panel.
Figure 5:
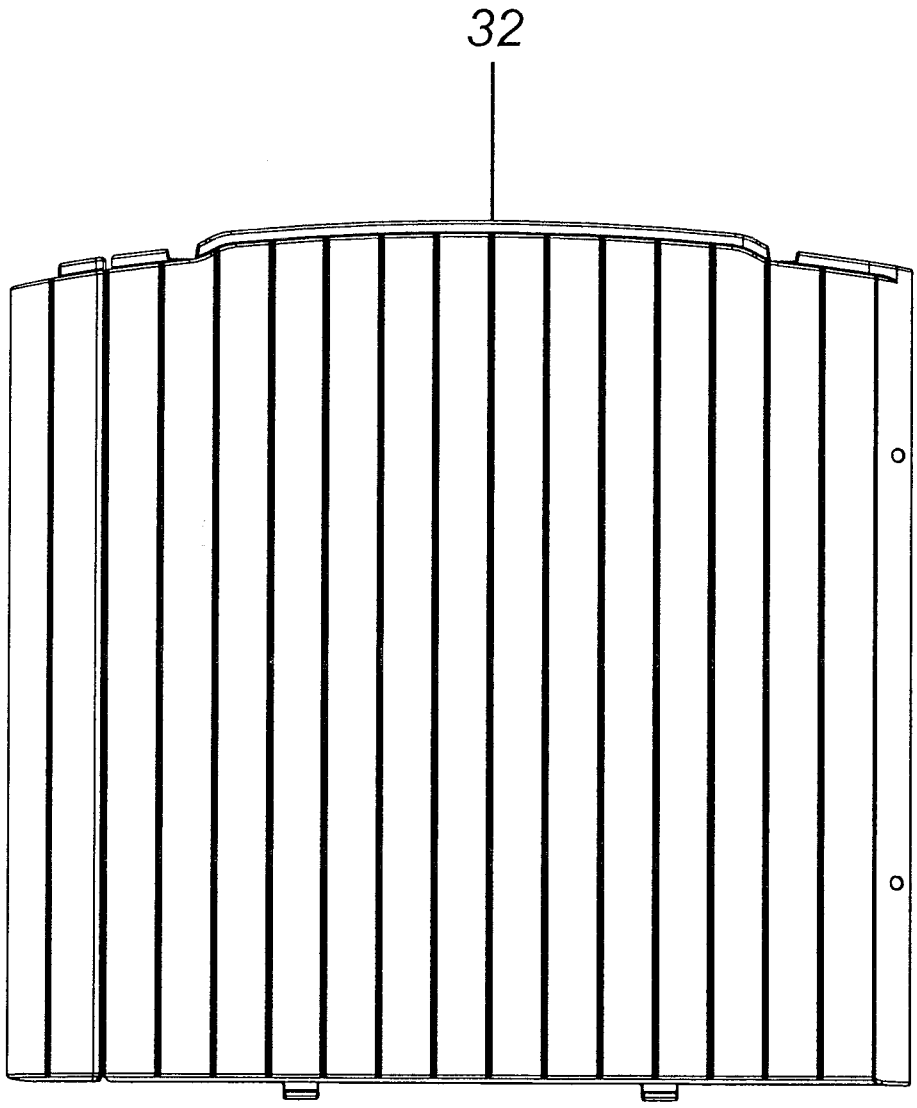
FIG. 5 is a rear panel.
Figure 6:
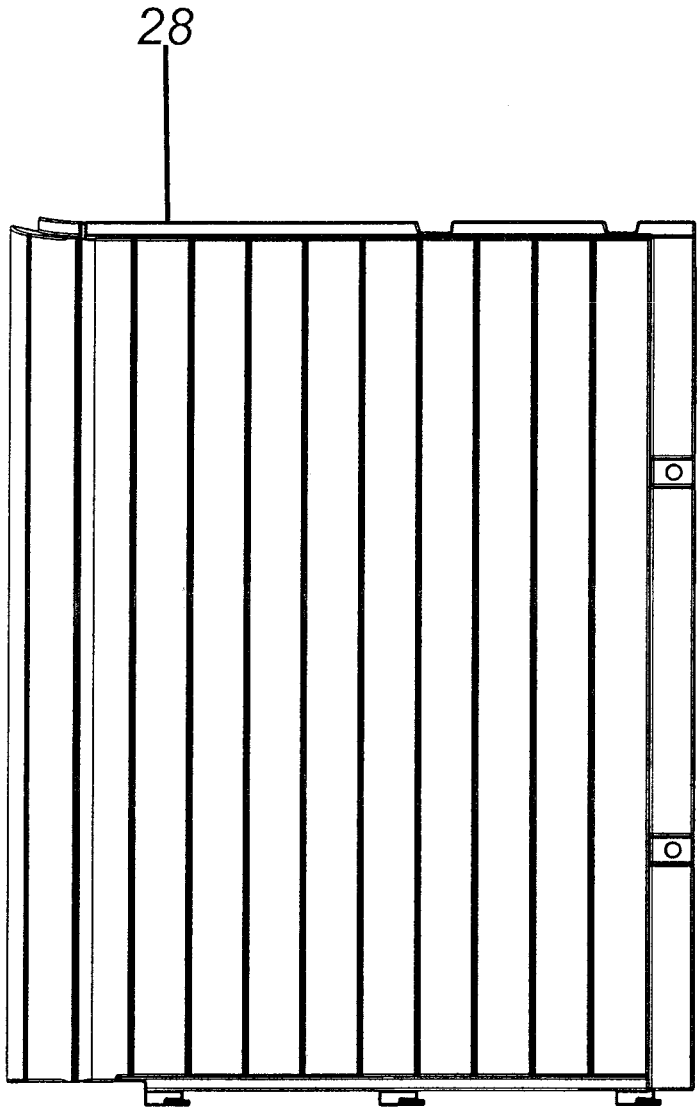
FIG. 6 is a left side wall rear panel.
Figure 7:
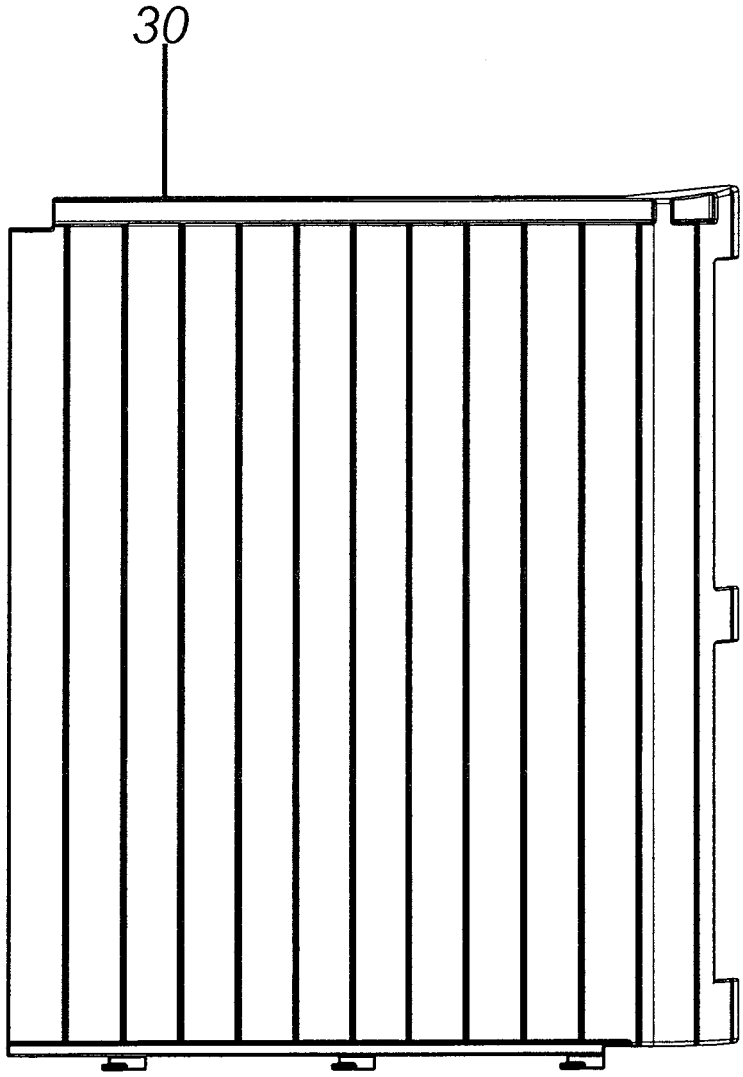
FIG. 7 is a left side wall front panel.
Figure 8:
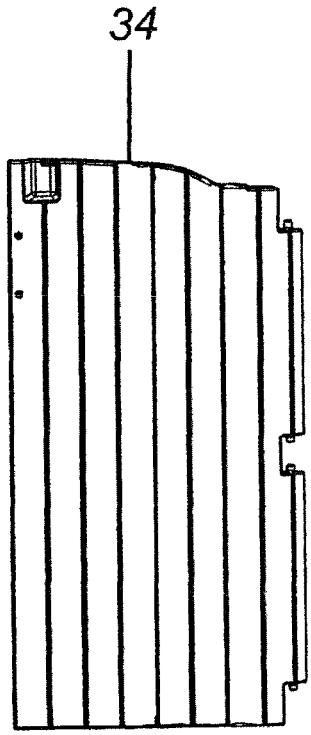
FIG. 8 is a left door.
Figure 9:
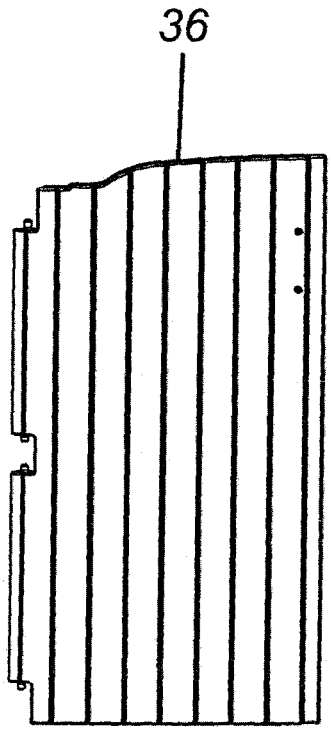
FIG. 9 is a right door.
Figure 10:
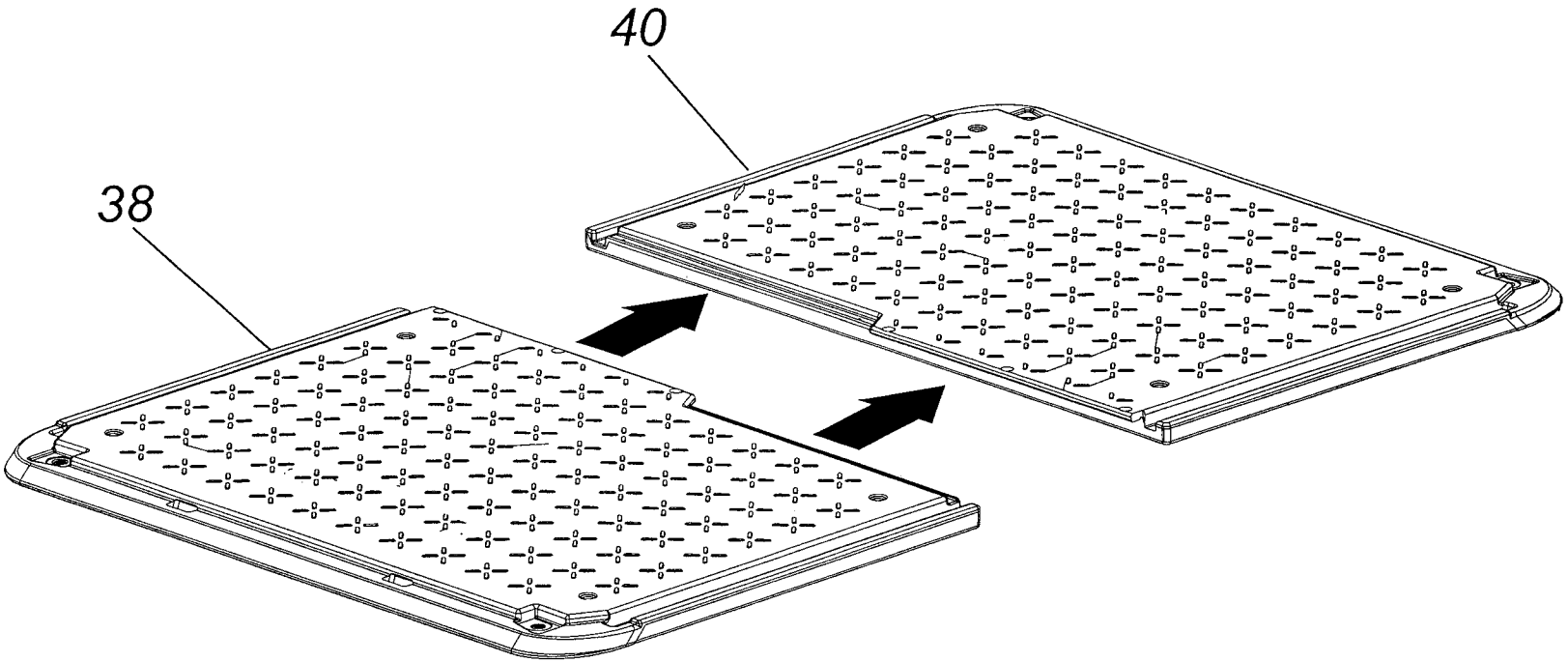
FIG. 10 is a perspective of the floor panels prior to assembly.
Figure 24:
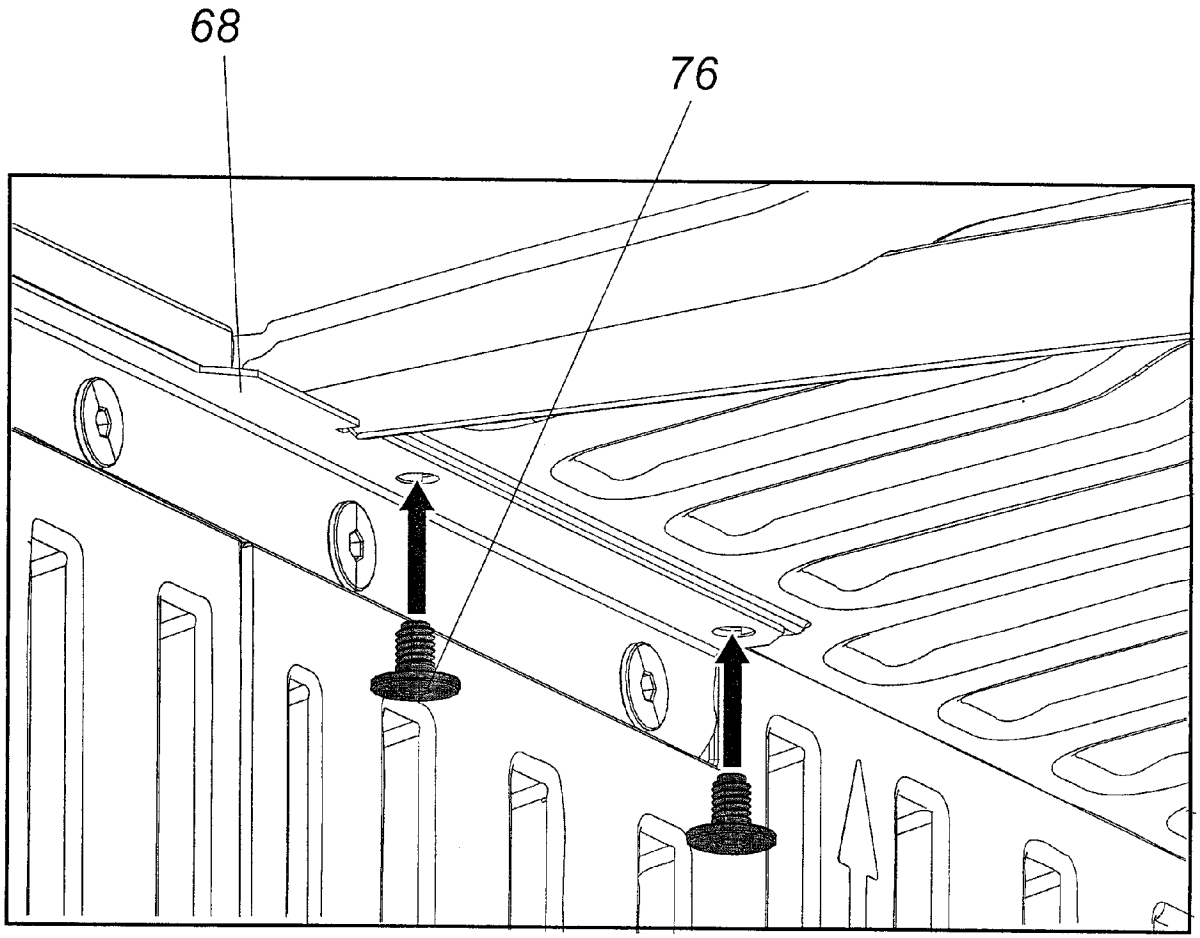
FIG. 24 is a perspective view of the connection of the roof guide to roof panel connection.
Figure 25:
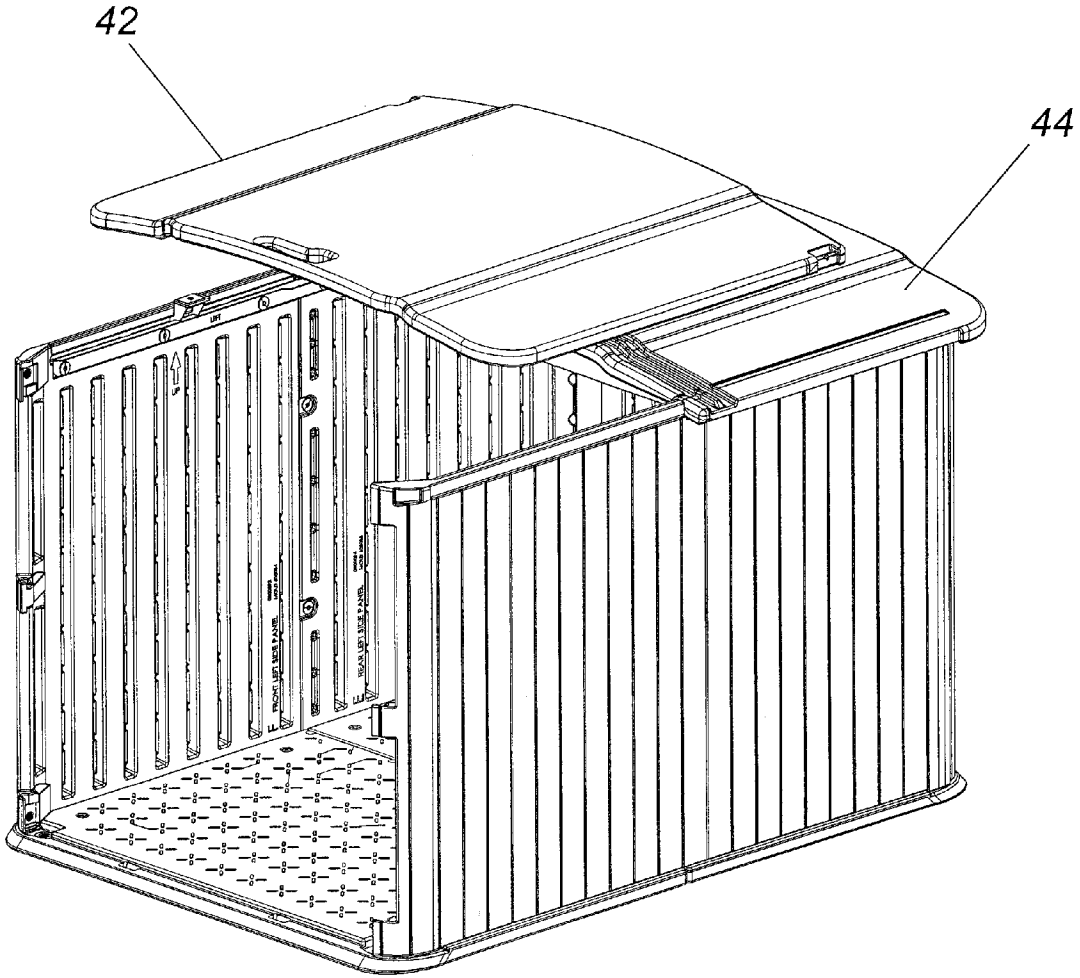
FIG. 25 is a perspective view of the sliding roof panel.

FIGS. 1-35, which are now referenced, illustrate perspective and exploded views of a system or kit for the assembly of a preferred embodiment of the present invention. A utility enclosure or shed is generally illustrated at 10 in FIG. 1. The enclosure or shed 10 includes a right side wall 12, a left side wall 14, a rear wall 16, doors 18, a floor 20, and a roof 22. The right side wall includes a right side front wall 24 and a right side rear wall 26 (FIGS. 3 and 4). The left side wall includes a left side front wall 28 and a left side rear wall 30 (FIGS. 6 and 7). A rear wall is identified as 32 in FIG. 5. The doors include a left door 34 and a right door 36 (FIGS. 8 and 9). The floor includes a front floor panel 38 and a rear floor panel 40 (FIG. 10). The roof includes a front roof panel 42 and a rear roof panel 44 (FIG. 25). These panels are preferably formed from molded plastic.

Figures 11A, 11B:
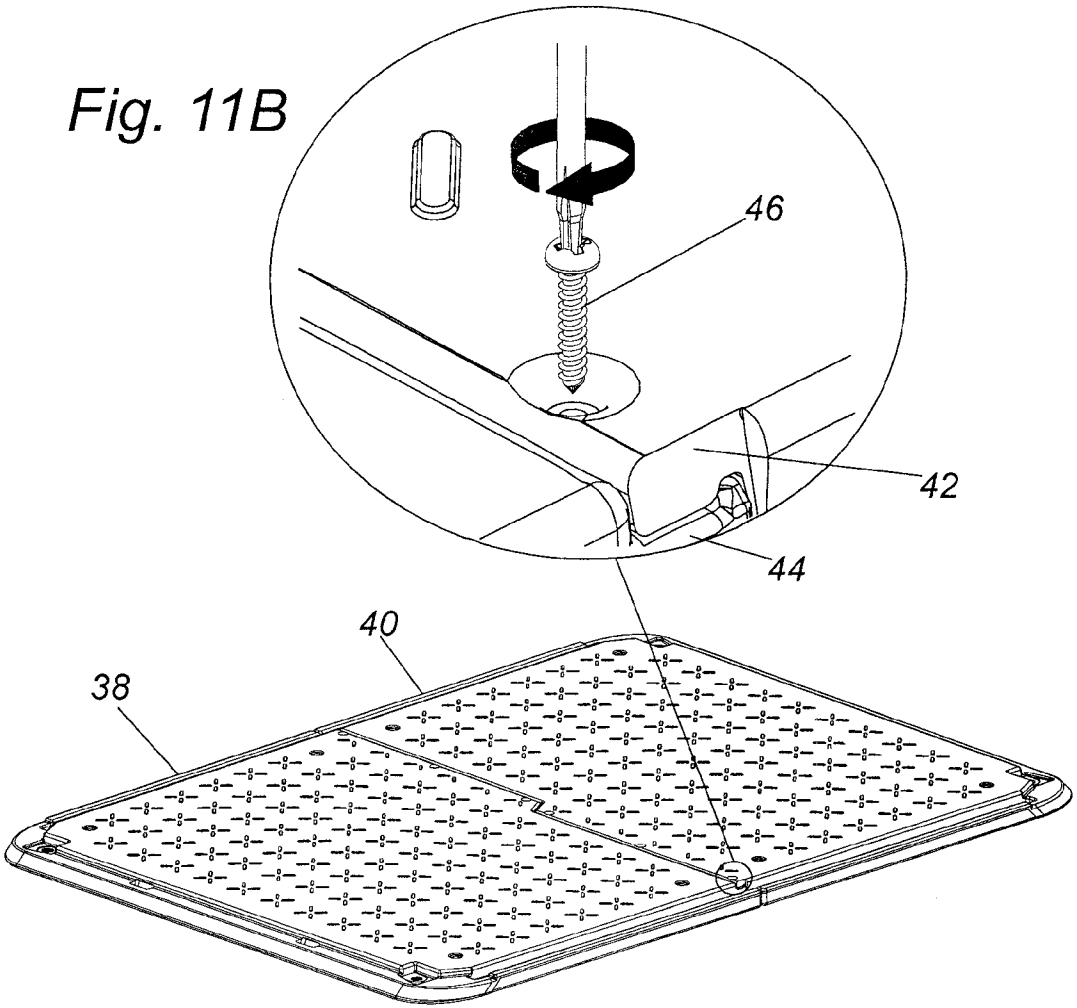
FIG. 11A is a perspective view of the assembled floor panels.
FIG. 11B is a view of the fasteners used to assemble the floor panels.
Figure 12B:
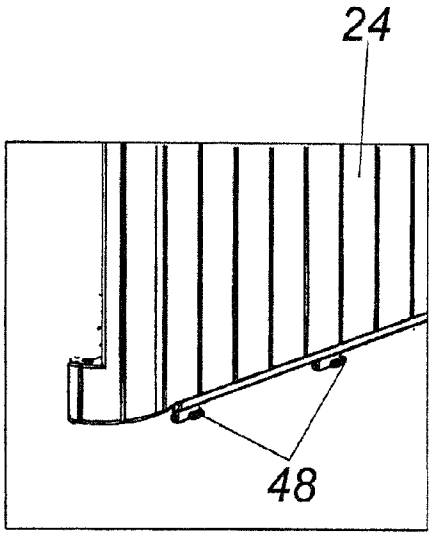
FIG. 12B is a detail of the right side wall panel and floor panel connection.
Figure 12A:
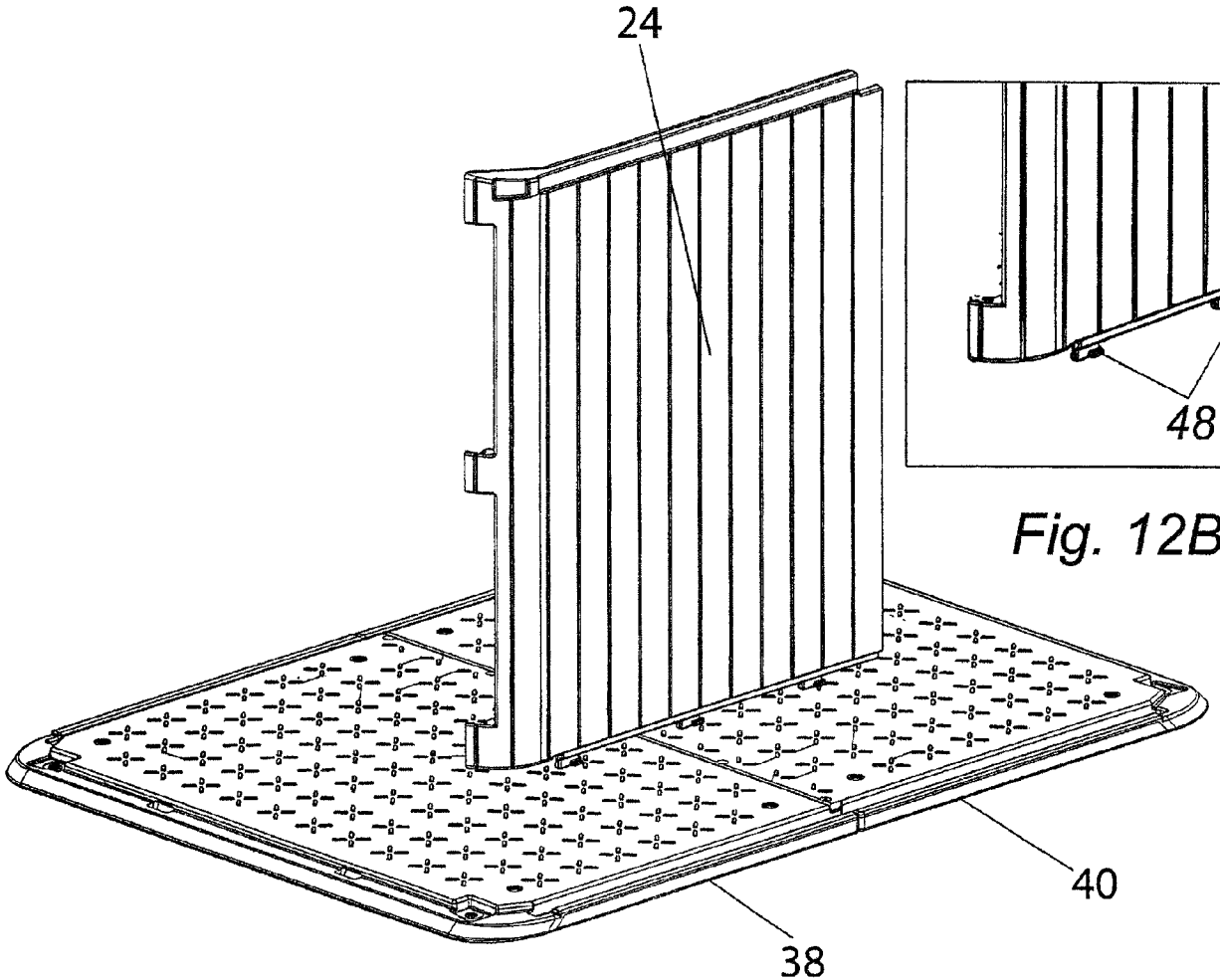
FIG. 12A is a perspective view of a right side wall panel and the floor panels.
Figures 13A, 13B:
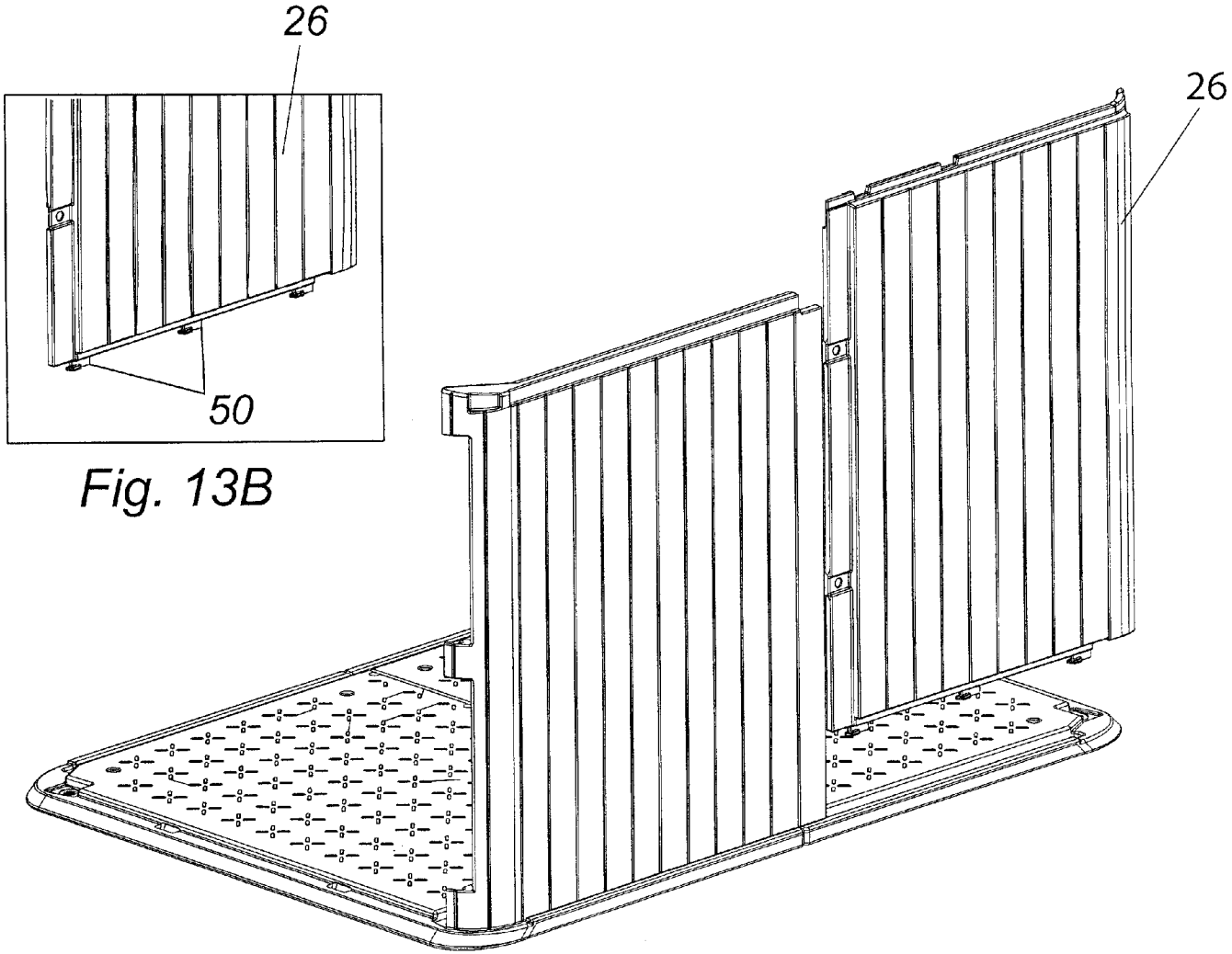
FIG. 13A is a perspective view of a right side wall panel and the floor panels.
FIG. 13B is a detail of the right side wall panel and floor panel connection.

The floor includes at least two floor panels 38 and 40 which are secured to each other to form the floor of the enclosure. The floor panels 38 and 40 are secured together in an overlapping connection as illustrated in FIGS. 11A and 11B. Rear floor panel 40 includes a projection or lip 42 which extends along a width of the panel. This lip 42 overlaps a projection or lip 44, which extends along a width of the panels, in an interlocking relation on the front floor panel (FIG. 11B). A plurality of fasteners 46 secure the front and rear floor panels together, as illustrated in FIG. 11B. These fasteners are preferably machine screws. However, other screws and/or fasteners can be employed.

Figures 14A, 14B:
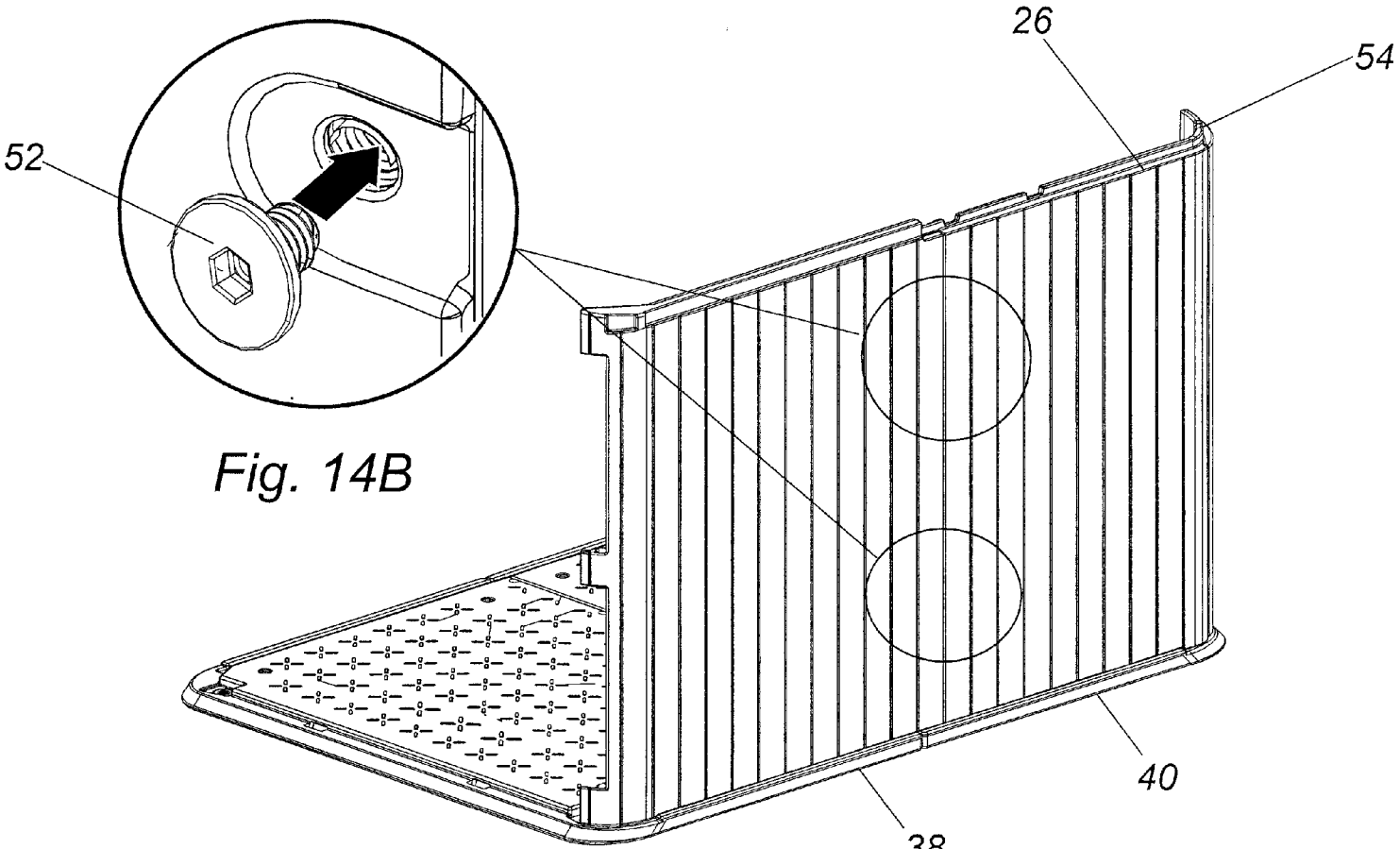
FIG. 14A is a perspective view of the right side wall panels secured together and secured to the floor panels.
FIG. 14B is a view of the fasteners used to secure the right side wall panels together.

The right side wall 12 includes a right side wall front panel 24 secured to a right side wall rear panel 26. First, the right side wall front wall panel 24 is secured to the front floor panel 38 in the manner illustrated in FIG. 12A. The right side wall front panel includes at least three bosses 48 located at a lower portion of the panel. These bosses 48 engage corresponding sockets (not shown) in the floor panel. The right side wall front panel 24 is placed on an edge of the floor panel 38. The bosses 48 then engage corresponding sockets and the panel 24 is slid rearward. This motion interlocks the bosses into the corresponding sockets. The right side wall rear panel 26 is installed on the rear floor panel 40 in a manner similar to the installation of the right side wall front panel 24. The panel 26 includes at least three bosses 50 located on a lower portion of the panel. These bosses 50 engage corresponding sockets (not shown) on the floor panel 40. The right side wall rear panel 26 is placed on an edge of the floor panel 40. The bosses 50 then engage corresponding sockets and the panel 26 is slid forward. This motion interlocks the bosses into the corresponding sockets. The right side wall front and rear panels are secured to each other with fasteners 52 at the locations indicated illustrated in FIG. 14A. As can be seen in FIG. 14A, the rear portion of right side wall rear panel includes a curved wall portion 54. This curved wall portion 54 forms a curved transition between the right side wall and the rear wall 32.

Figure 15:
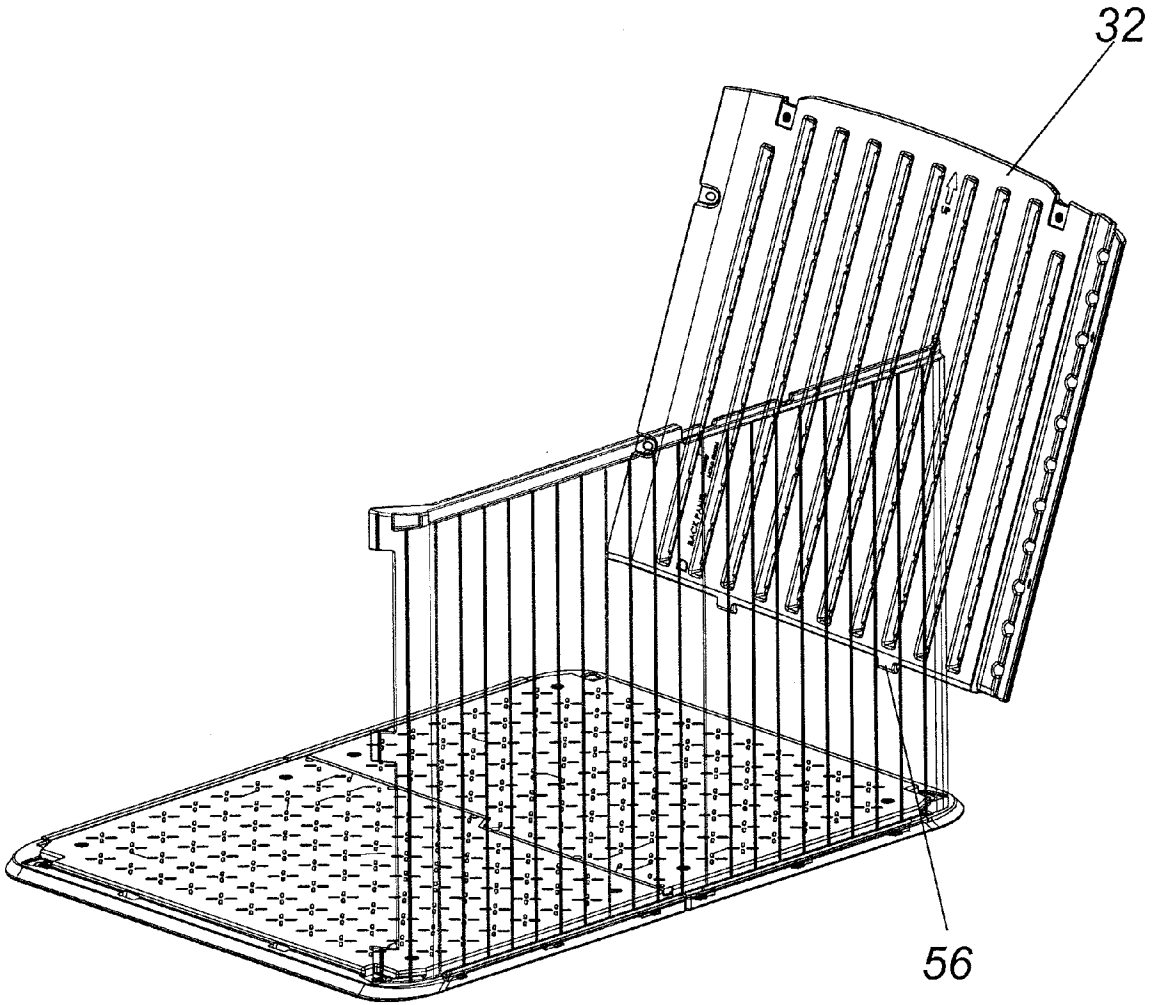
FIG. 15 is a perspective view of the rear panel being secured to the floor panels.
Figure 16:
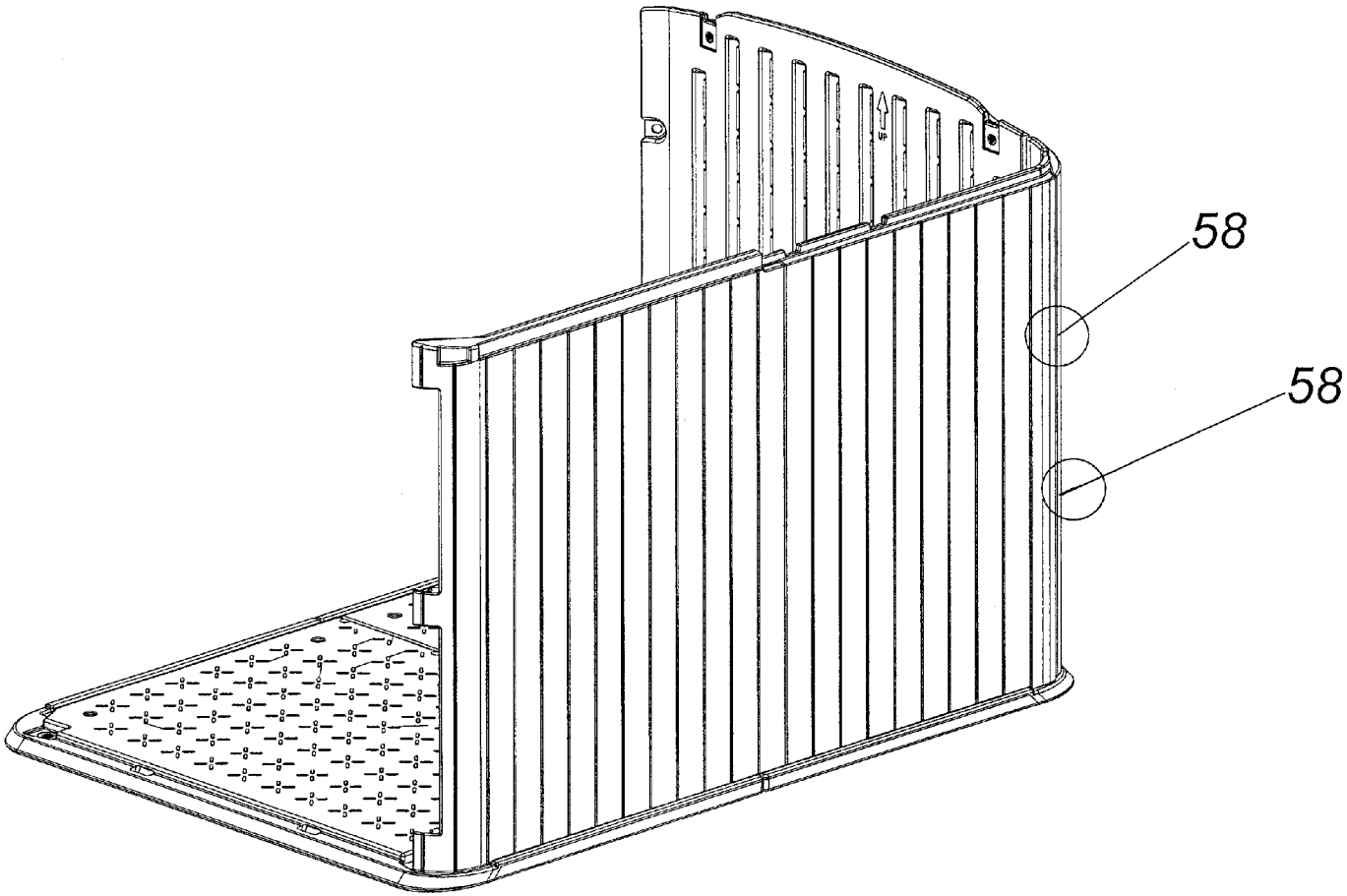
FIG. 16 is a perspective view of the right side panels and rear panel assembled.

The rear wall panel 32 includes at least two bosses 56 (FIG. 15). These bosses are located on a lower portion of the rear wall panel. These bosses 56 engage corresponding sockets (not shown) on the floor panel 40. The rear wall rear panel 32 is placed on an edge of the floor panel 40. The bosses 56 then engage corresponding sockets in the floor panel 40 and the rear wall panel 32 is slid either to the left or to the right. This motion interlocks the bosses into the corresponding sockets. Fasteners, similar to fasteners 52, are used to secure the rear wall panel 32 to the right side wall rear panel 26, as illustrated at 58 in FIG. 16.

Figures 17A, 17B:
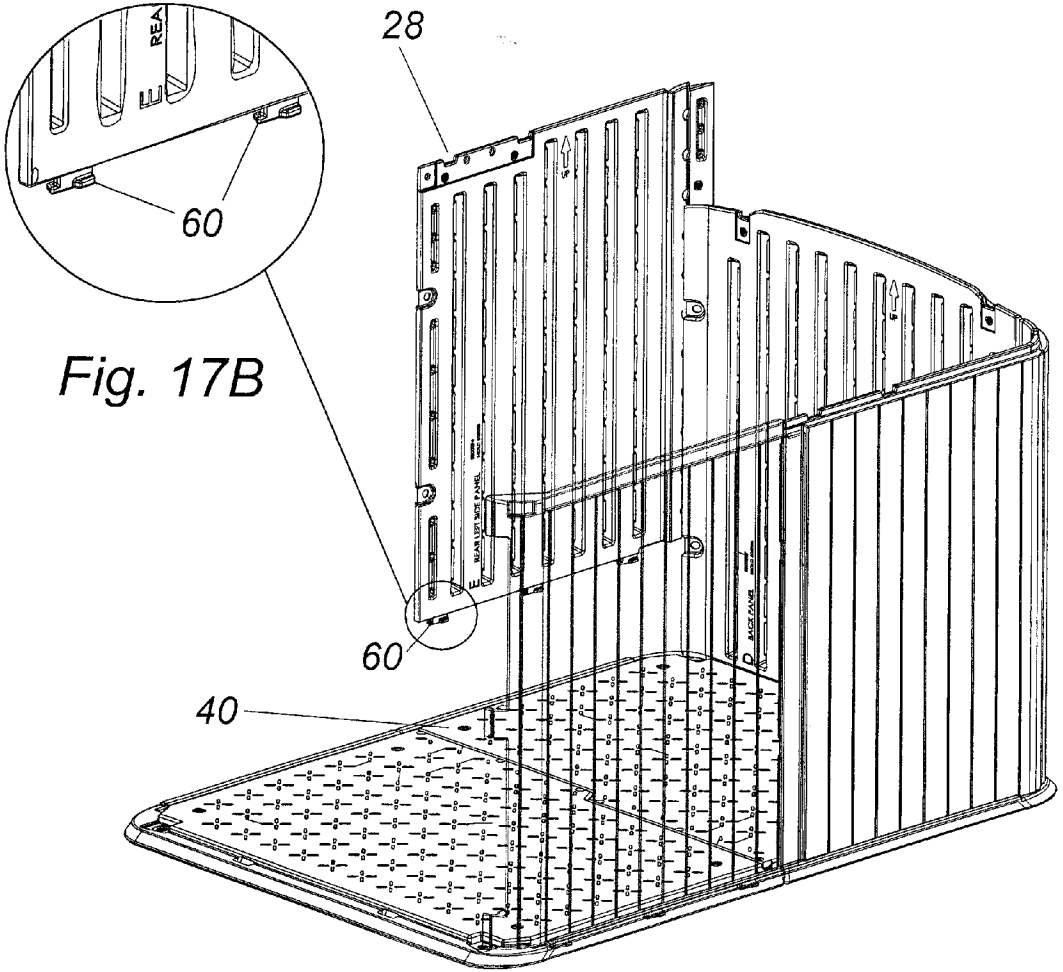
FIG. 17A is a perspective view of a left side panel being secured to the rear panel and floor panels.
FIG. 17B is a detail of the left side wall panel and floor panel connection.
Figures 18A, 18B:
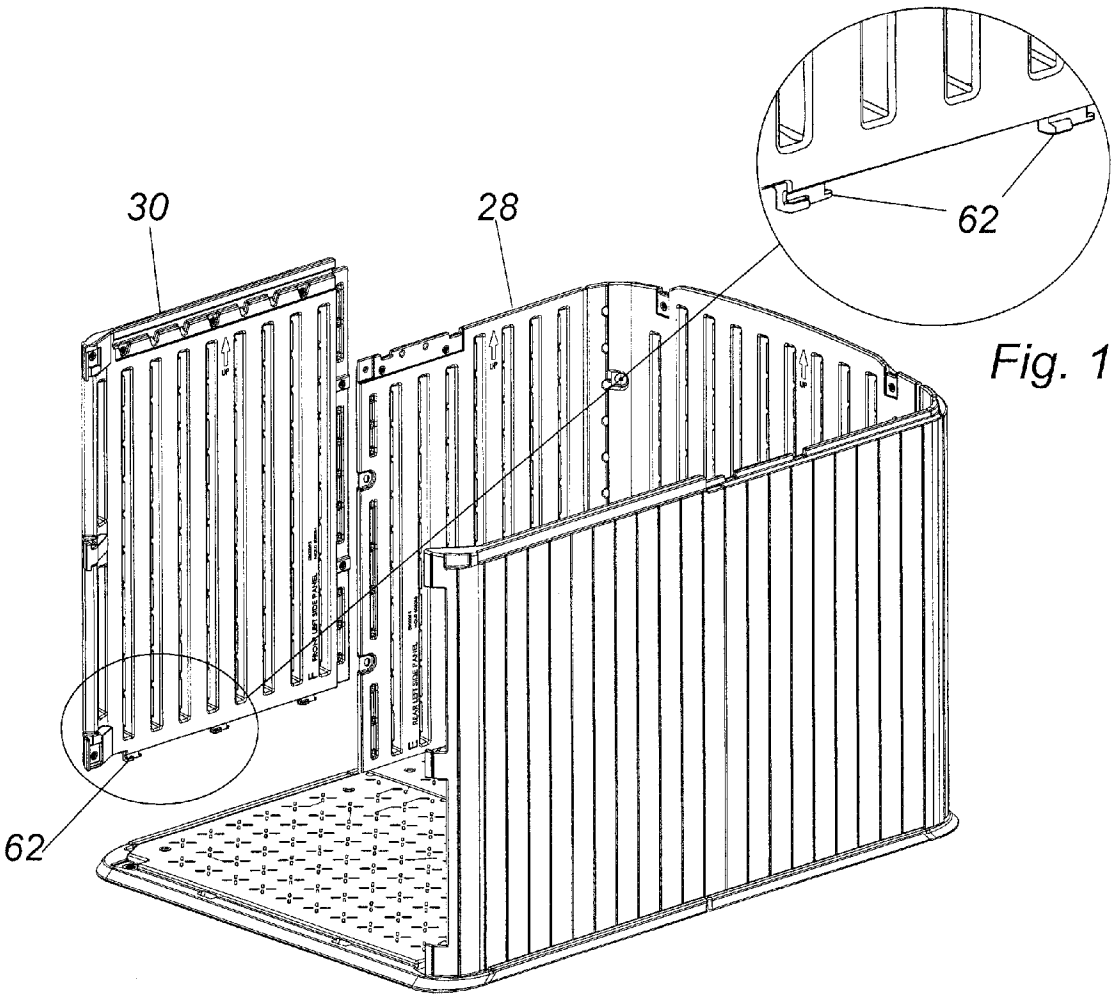
FIG. 18A is a perspective view of a left side wall panel being secured to the floor panels.
FIG. 18B is a detail of the left side wall panel and floor panel connection.
Figure 19:
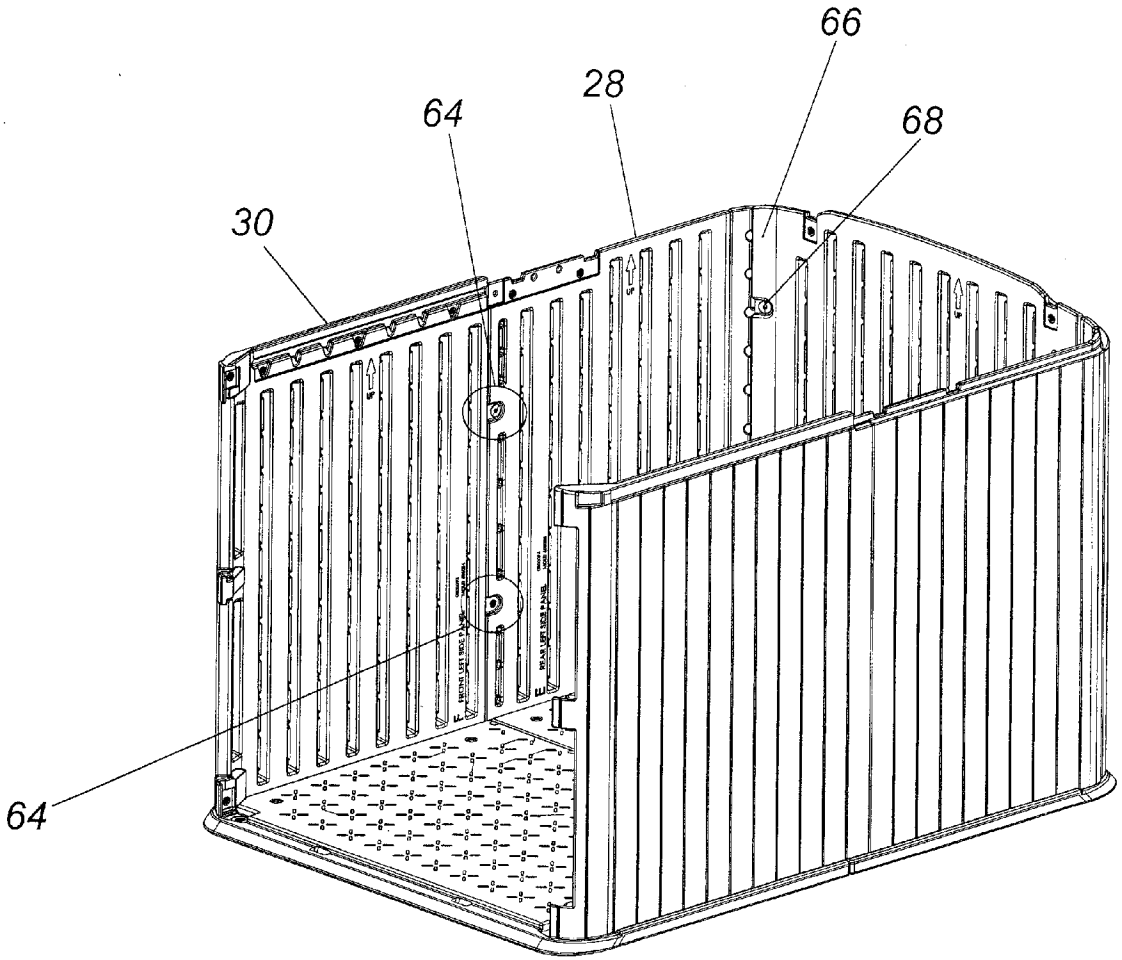
FIG. 19 is a perspective view of the left side wall panels in their assembled positions.

The left side wall 14 includes a left side wall front panel 30 secured to a left side wall rear panel 28. First, the left side wall rear wall panel 28 is secured to the rear floor panel 40 in the manner illustrated in FIG. 17A. The left side wall rear panel includes at least three bosses 60 located at a lower portion of the panel (FIGS. 17A and B). These bosses 60 engage corresponding sockets (not shown) in the floor panel. The left side wall rear panel 28 is placed on an edge of the floor panel 40. The bosses 60 then engage corresponding sockets and the panel 28 is slid forward. This motion interlocks the bosses into the corresponding sockets. The left side wall front panel 30 is installed on the front floor panel 38 in a manner similar to the installation of the left side wall rear panel 28. The panel 30 includes at least three bosses 62 located on a lower portion of the panel. These bosses 62 engage corresponding sockets (not shown) on the floor panel 38. The left side wall front panel 30 is placed on an edge of the floor panel 30. The bosses 62 then engage corresponding sockets and the panel 30 is slid forward. This motion interlocks the bosses into the corresponding sockets. The left side wall front and rear panels are secured to each other with fasteners, similar to fasteners 52, at the locations 64 indicated in FIG. 19. As can be seen in FIG. 19, the rear portion of left side wall rear panel includes a curved wall portion 66. This curved wall portion 66 forms a curved transition between the right side wall and the rear wall 32. Fasteners, similar to fasteners 52, are used to secure the rear wall panel 32 to the left side wall rear panel 28, as illustrated at 68 in FIG. 19.

Figure 20B:
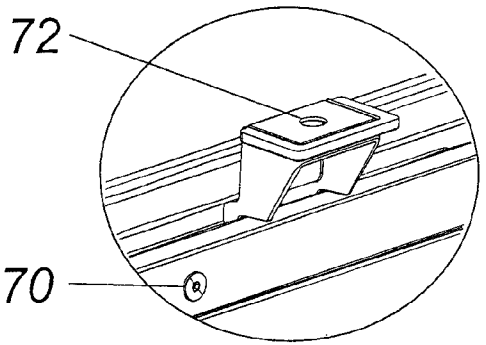
FIG. 20B is perspective view of an inner roof guide.
Figure 20A:
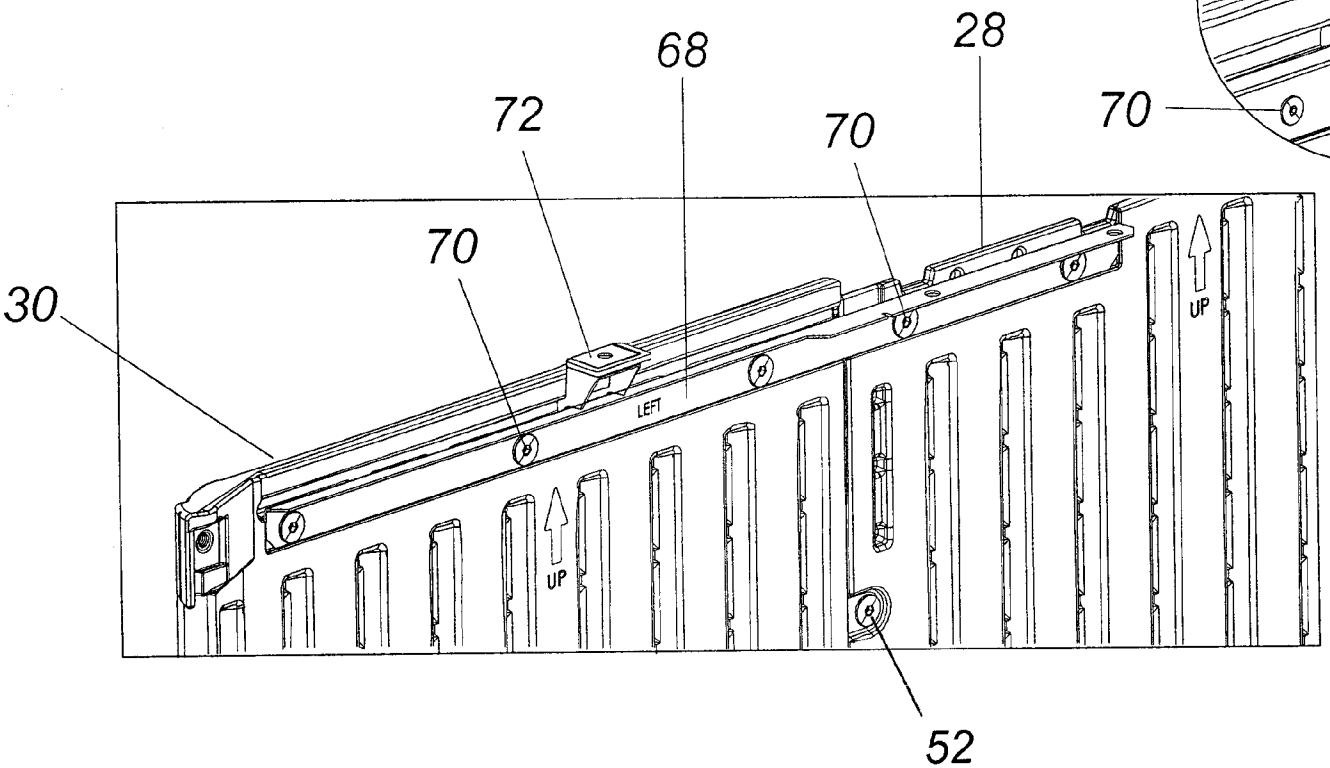
FIG. 20A is a perspective view of a roof guide installed on the left side wall panels.

The roof includes a front roof panel 42 and a rear roof panel 44 (FIG. 25). The rear roof panel 44 is secured to the right, left and rear wall panels in a fixed position. The front roof panel 42 is movable between an open position (FIG. 22A) and a closed position (FIG. 1). The roof panels 42 and 44 are convexly curved along a traverse cross section, thereby permitting rain and other weather elements to shed off of the roof A roof guide 68 is secured to an upper portion of both the front and rear left side wall panels 30 and 28 (FIG. 20A). Fasteners 70 are used to secure roof guide 68 to the side wall panels. Fasteners 70 are similar to fasteners 52. Roof guide 68 also provides an additional device or means to secure the front and rear left side wall panels to each other. A similar roof guide (not shown) is secured to the upper portions of the front and rear right side wall panels in the same manner as roof guide 68. An inner roof guide 72 is slidably secured between the roof guide 68 and the left side wall front panel 30 (FIG. 20B). Another inner roof guide (not shown) is secured between the other roof guide and the right side wall front panel. Both inner roof guides are secured to the front roof panel 42. The inner roof guides and roof guides allow the front roof panel to slidably move between an open and a closed position.

Figure 21B:
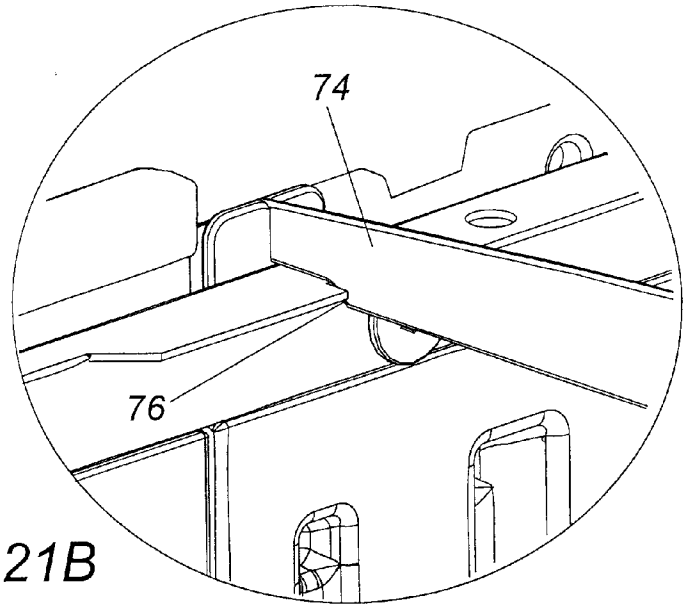
FIG. 21B is a detail of the roof support and side wall panel connection.
Figure 21A:
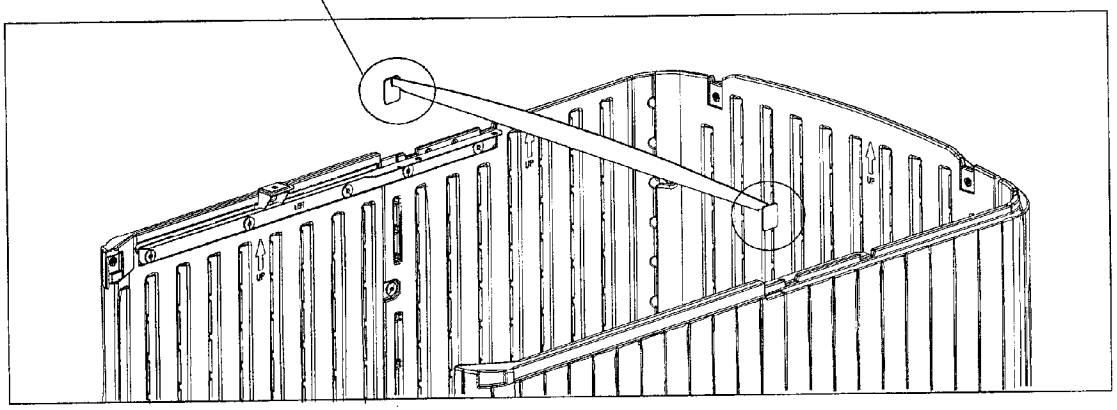
FIG. 21A is a perspective view of a roof support being installed.
Figure 22B:
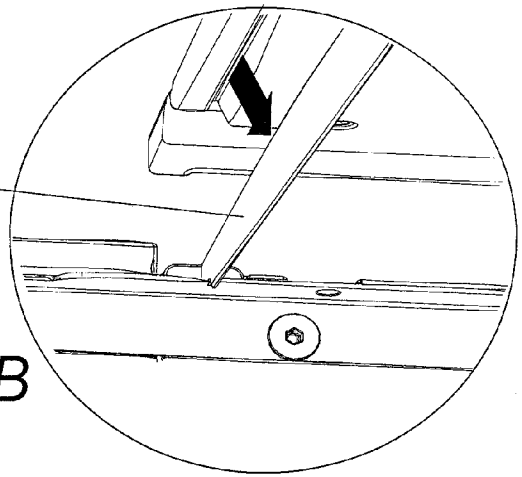
FIG. 22B is a detailed view of the roof support, roof panel connection.
Figure 22A:
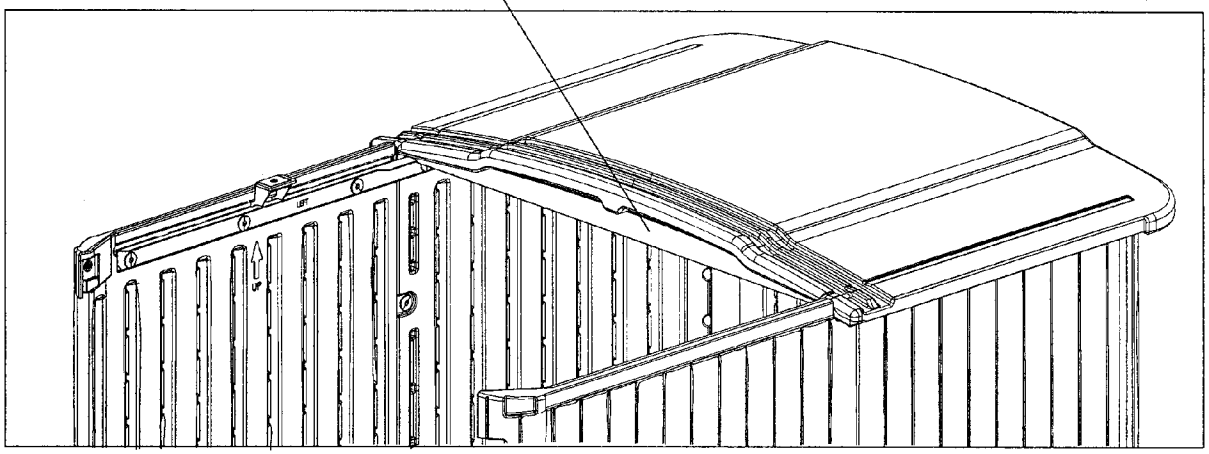
FIG. 22A is a perspective view of a roof panel installed on the side wall panels.
Figures 23A, 23B:
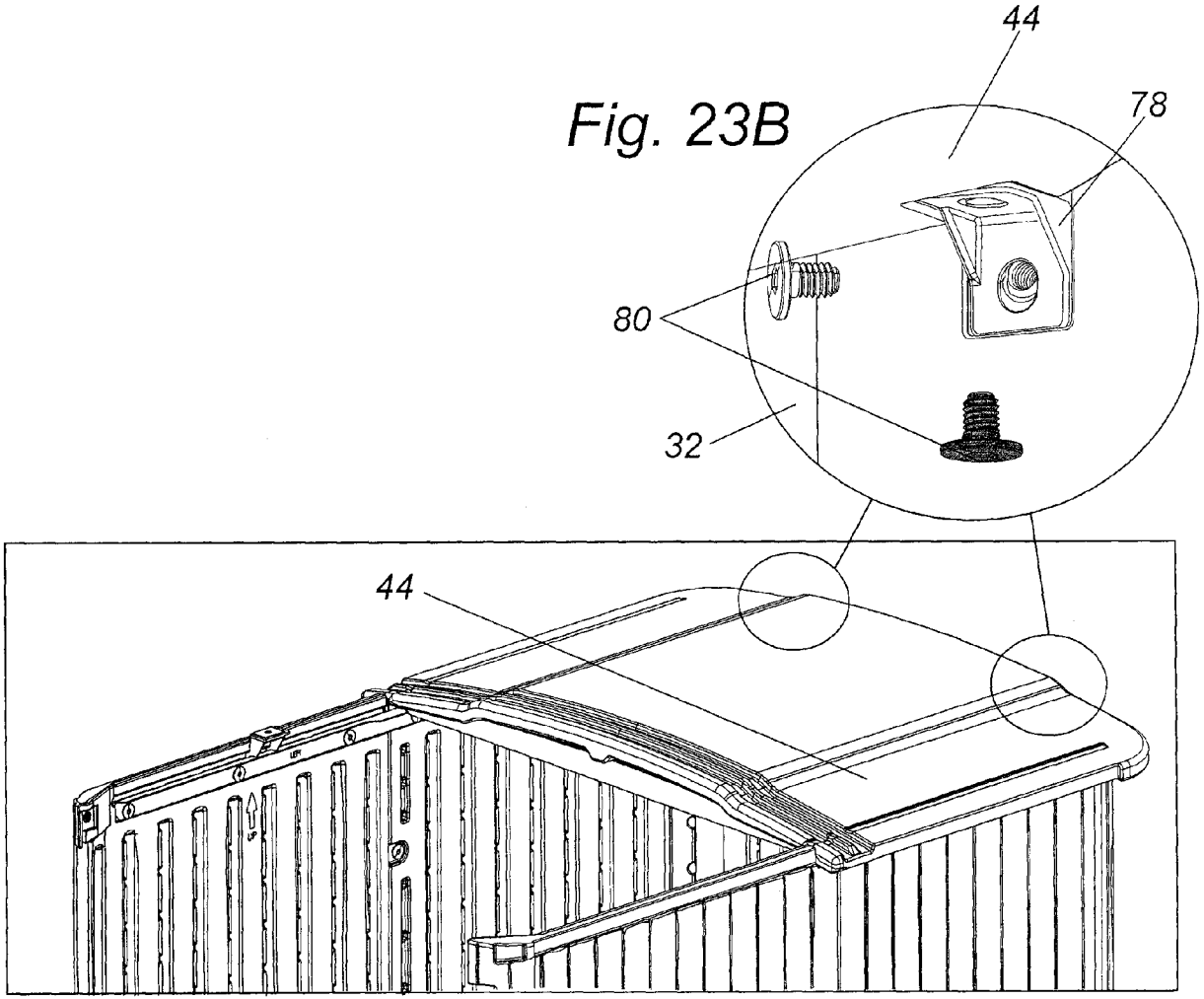
FIG. 23A is a view of the location of the rear panel to roof retainer clips.
FIG. 23B is a detail of the connection of the rear panel to roof retainer clips.

A roof support 74 is secured between the roof guides (FIGS. 21A and 22A). A slot 76 is formed on both the roof supports into which respective ends of the roof support 74 is inserted. The front of the rear roof panel 44 is placed onto the roof support 74 (FIGS. 22A and B). The sides of the rear roof panel 44 are secured to the roof guides 68 with fasteners 76, as illustrated in FIG. 24. The other side of the rear roof panel 44 is also secured to a roof guide (not shown) with fasteners 76 in a similar manner. The rear end portion of the rear roof panel 44 is secured to the rear wall panel with retainers 78 and fasteners 80 (FIG. 23B). All of these connections secure the rear roof panels 44 to the right, left and back wall panels in a fixed position.

Figures 26A, 26B:
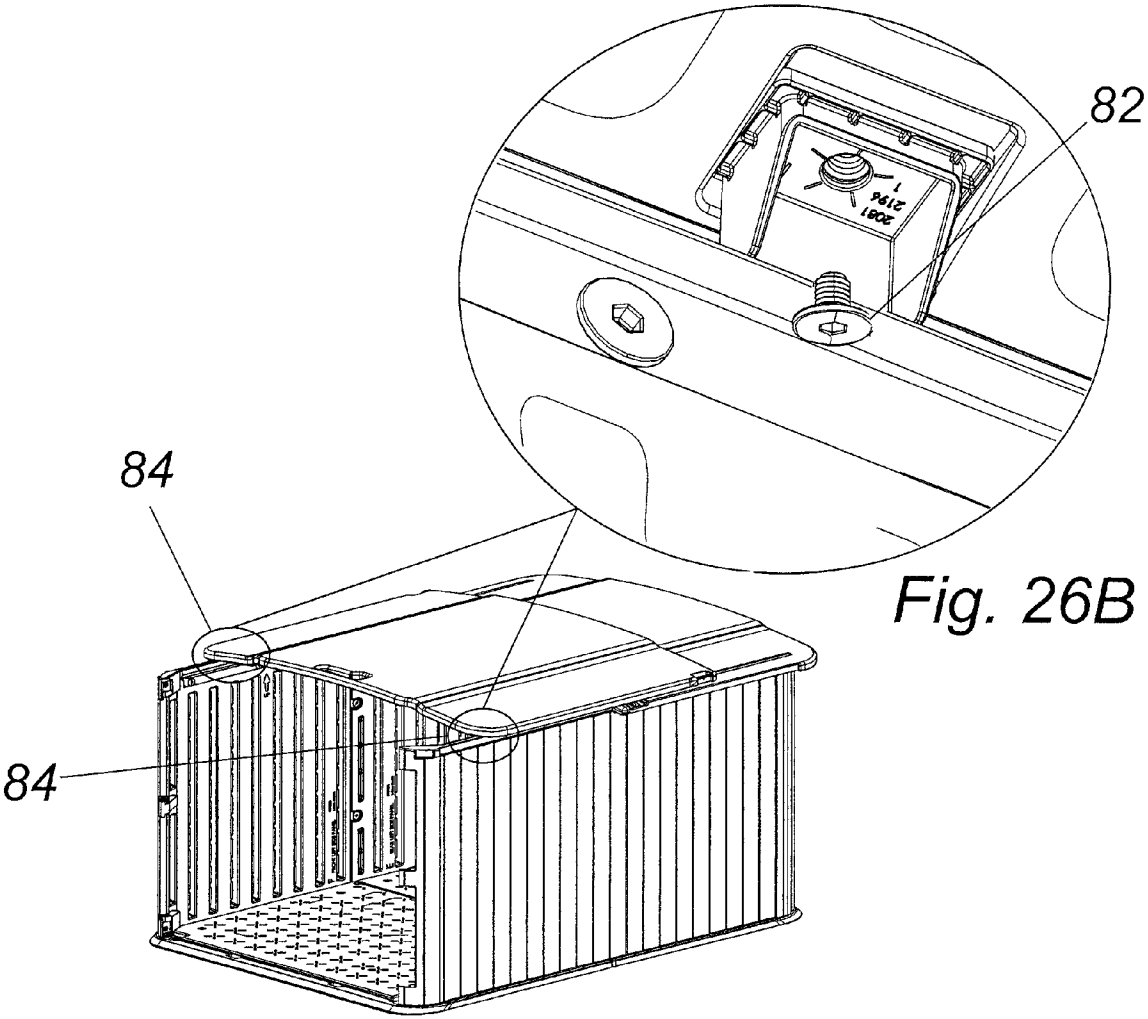
FIG. 26A is a perspective view of the sliding roof panel installed.
FIG. 26B is a perspective view of a roof guide installed on the sliding roof panel.
Figure 27A:
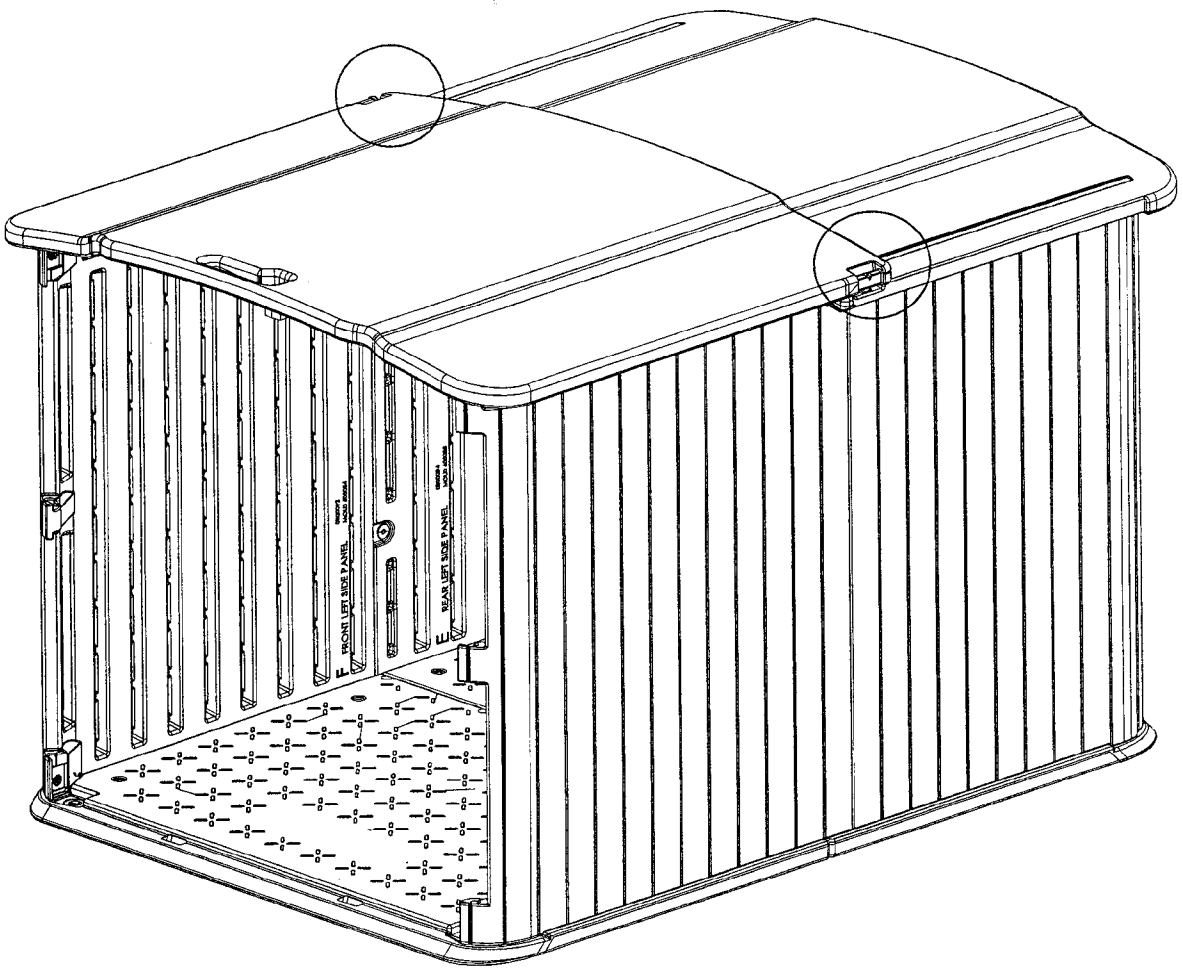
FIG. 27A is a perspective view of the location of the roof clips.
Figure 27B:
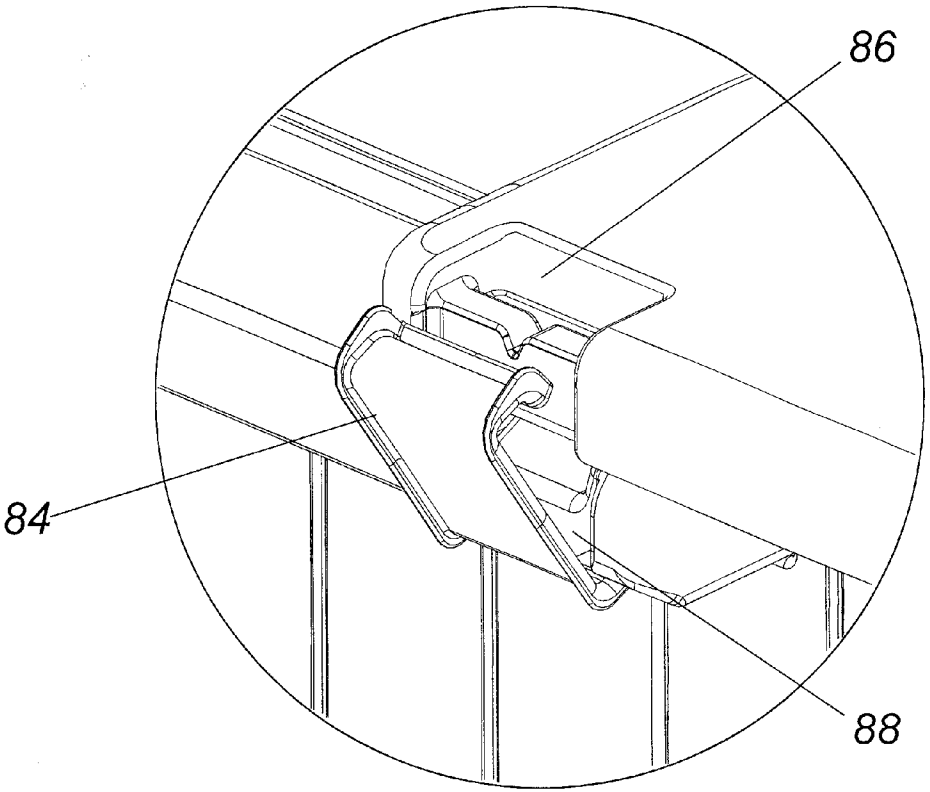
FIG. 27B is a view of a roof clip being installed.
Figure 27C:
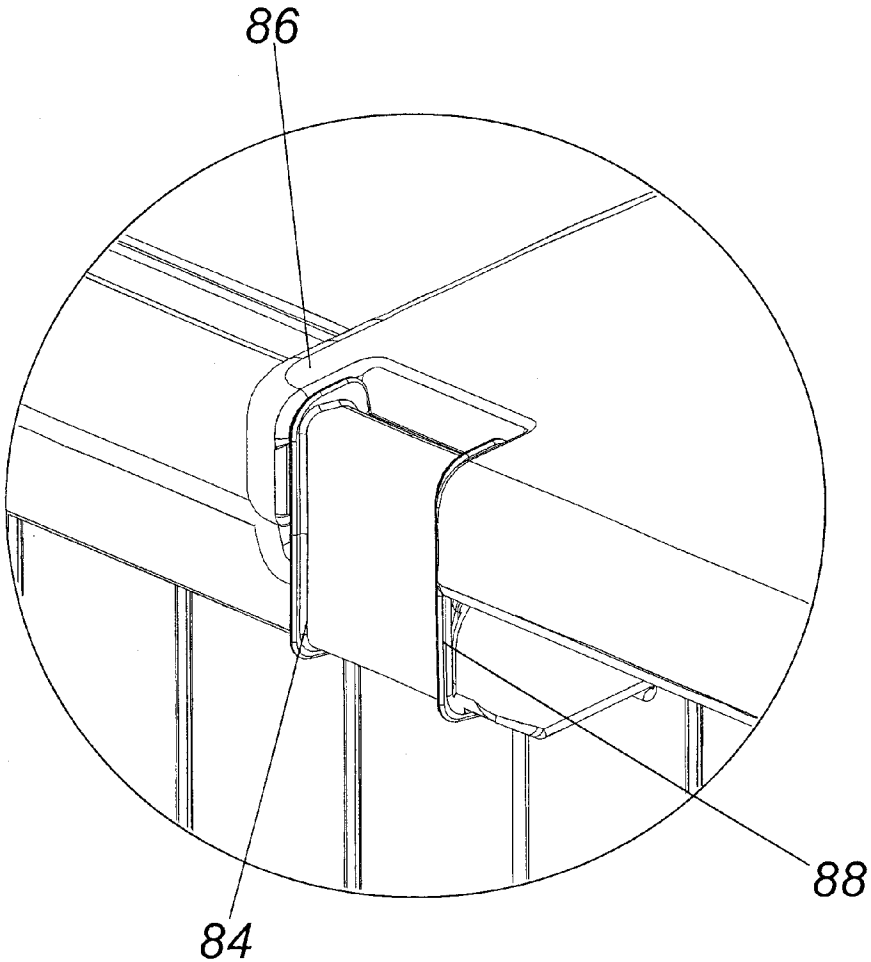
FIG. 27C is a view of an installed roof clip.
Figure 27D:
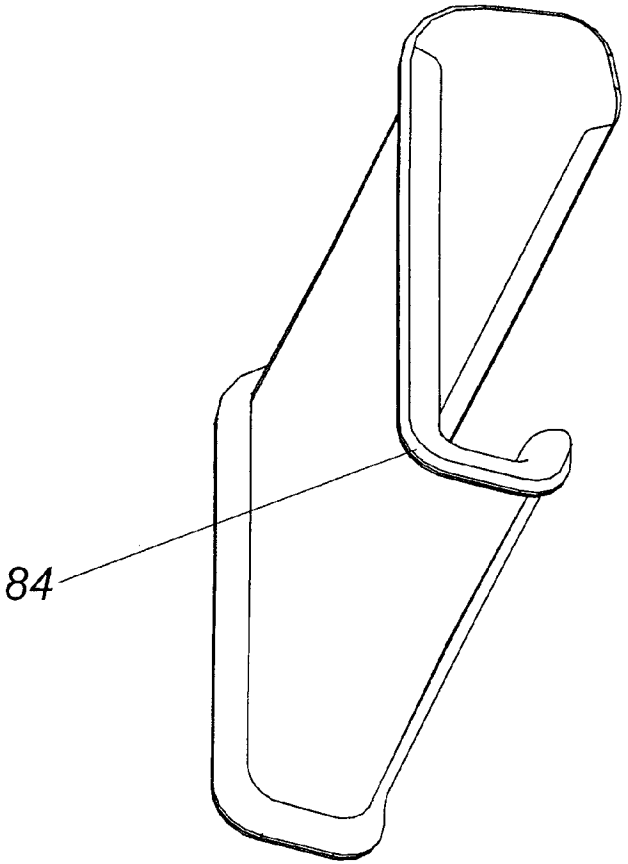
FIG. 27D is a side view of a roof clip.
Figure 28:
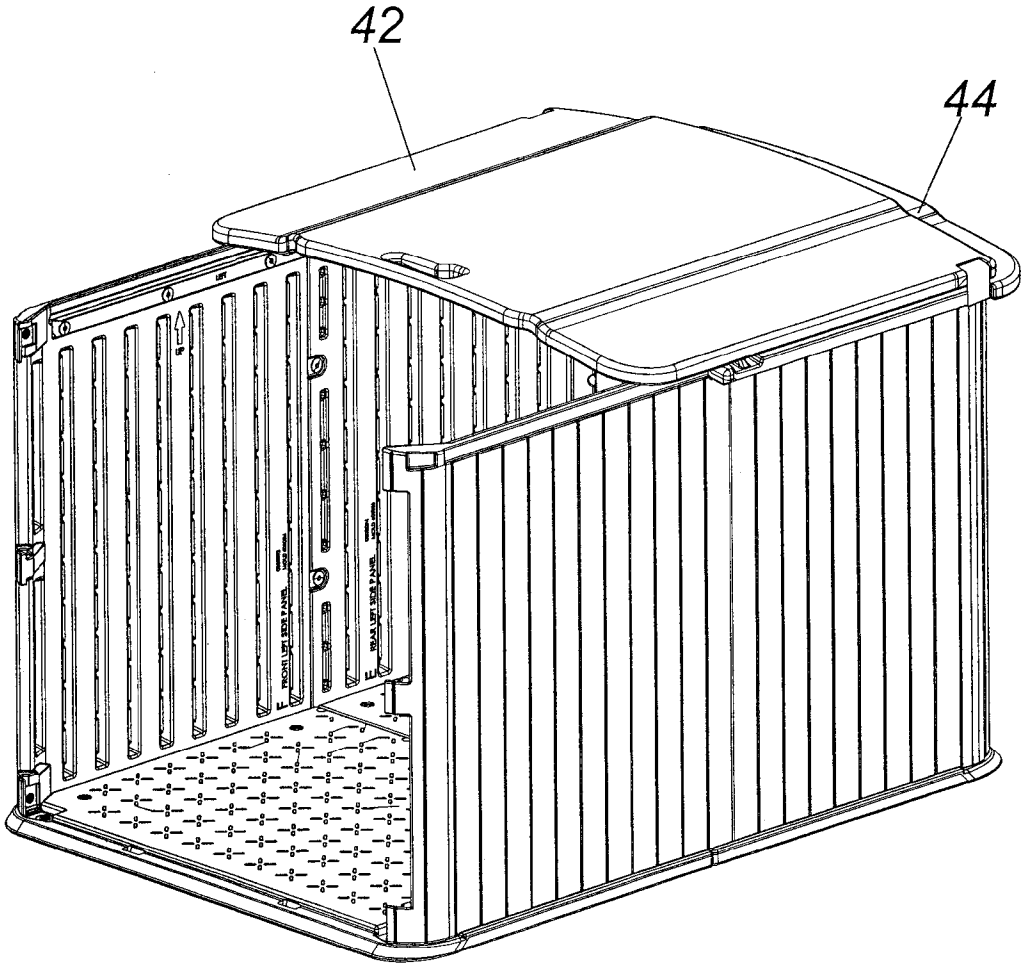
FIG. 28 is a perspective view of the enclosure with a roof panel in the back or open position.
Figure 29:
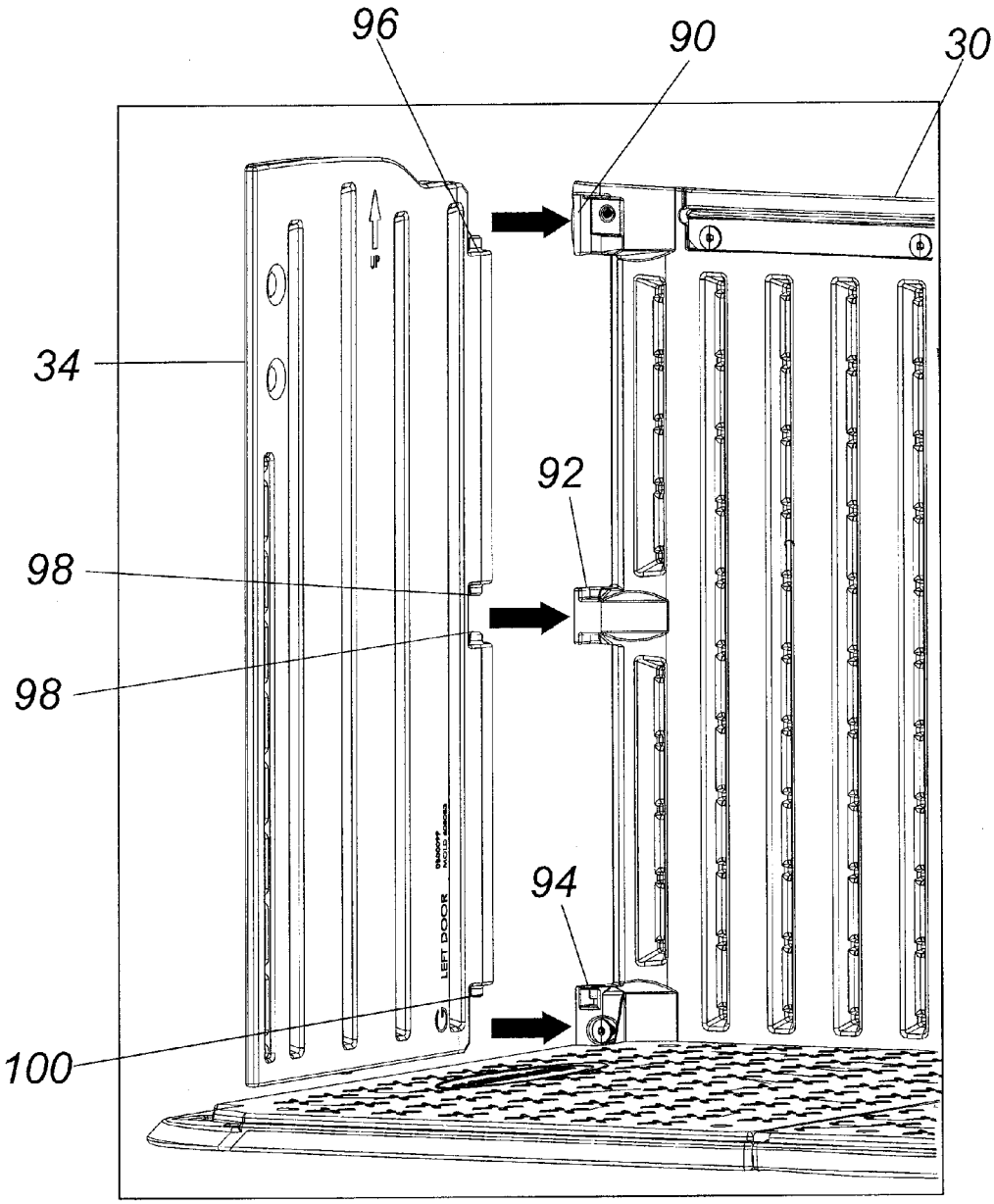
FIG. 29 is a perspective view of a left door panel being installed.

The front roof panel 42 is secured to the inner roof guides 72 using fasteners 82 (FIG. 26B). The inner roof guides are preferably secured to a forward portion of the front roof panel 42 as indicated at 84 in FIG. 26A. When the front roof panel 42 is in the closed position (FIG. 1) the rear portion of the panel 42 is secured to the front portion of rear roof panel 44 by at least two clips 84 (FIGS. 27A-D). As illustrated in FIGS. 27A-C there is a groove or slot 86 on both sides of a rear portion of the front roof panel 42 and a groove or slot 88 on both sides of a front portion of the rear roof panel 44. When the roof panels are in the closed position, the lower portion of clip 84 is first placed into groove or slot 88 and then pivoted upward to be placed into groove or slot 86. This connection securely locks the front roof panel 42 to the rear roof panel, thereby preventing the roof panels from separating and preventing access to the interior of the enclosure. When it is desired to open the roof, the clips 84 are removed and the front roof panel 42 is slid rearwardly, as illustrated in FIG. 28.

Figures 30A, 30B:
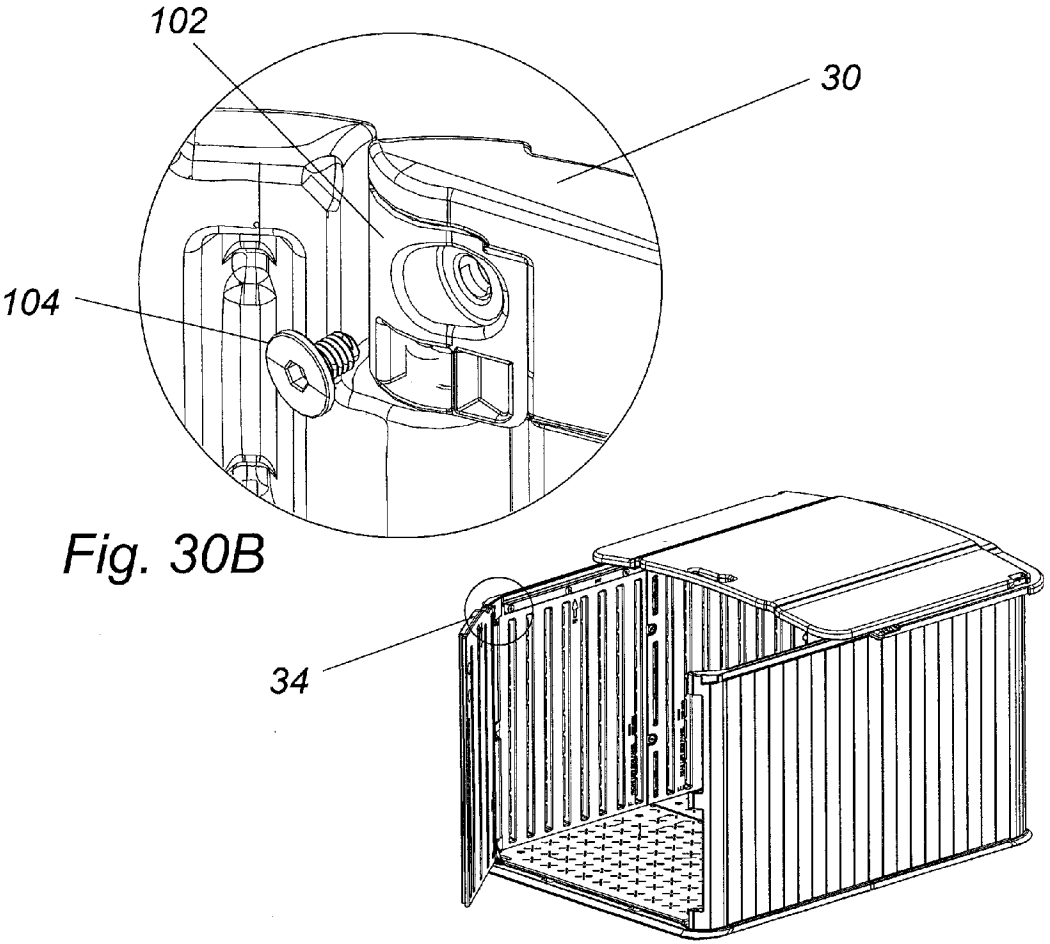
FIG. 30A is a view of the left door panel installed.
FIG. 30B is a view of the left upper door retainer.
Figure 31B:
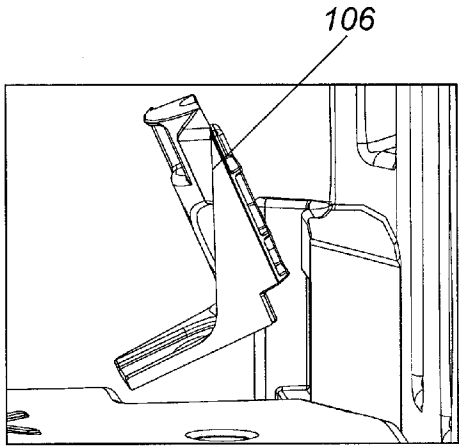
FIG. 31B is a view of a left lower door retainer being installed.
Figure 31C:
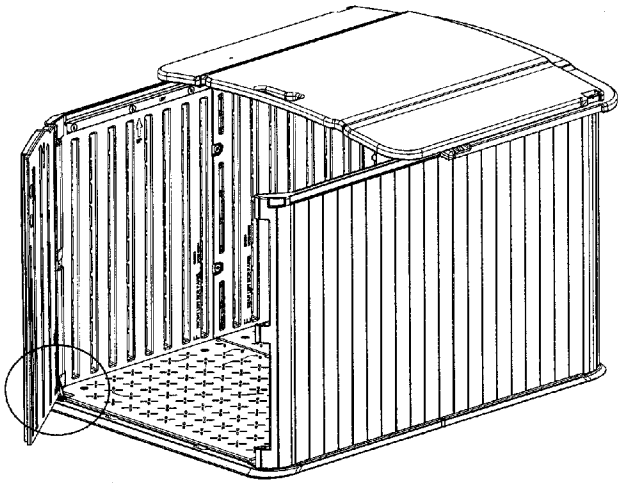
FIG. 31C is a view of the location of the left lower door retainer.
Figure 31A:
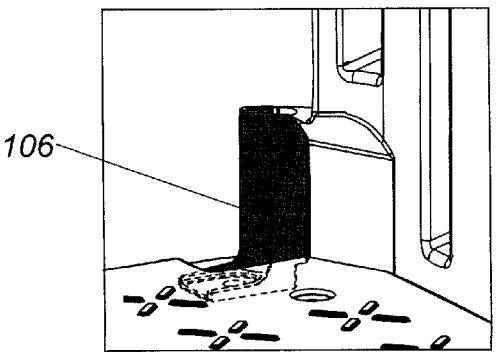
FIG. 31A is a view of a left lower door retainer installed.
Figures 32A, 32B:
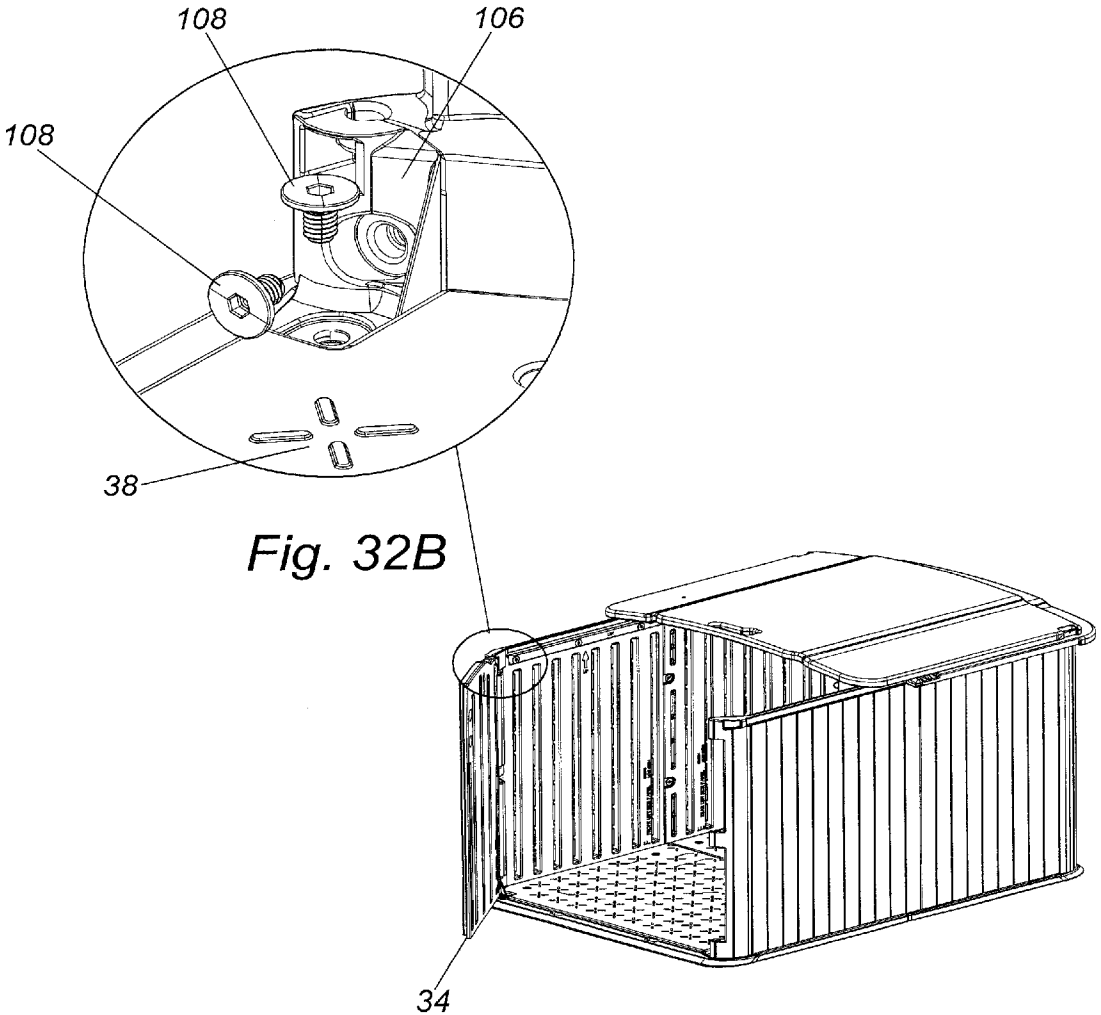
FIG. 32A is a view of the location of the left upper door retainer.
FIG. 32B is a view of the fasteners used to install the left lower door retainer.
Figure 33:
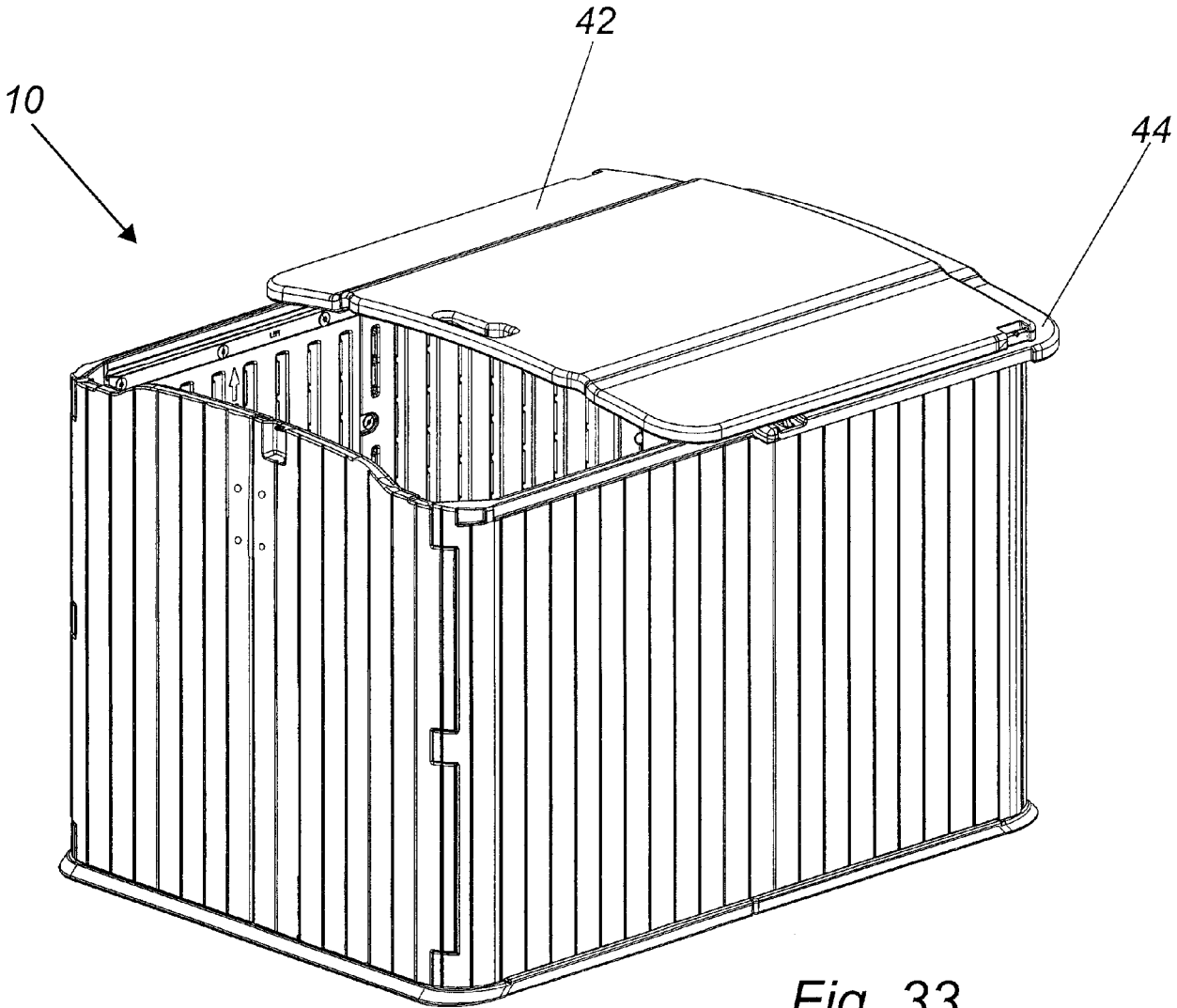
FIG. 33 is a perspective view of the assembled enclosure with the roof panel in the back or open position.
Figure 34B:
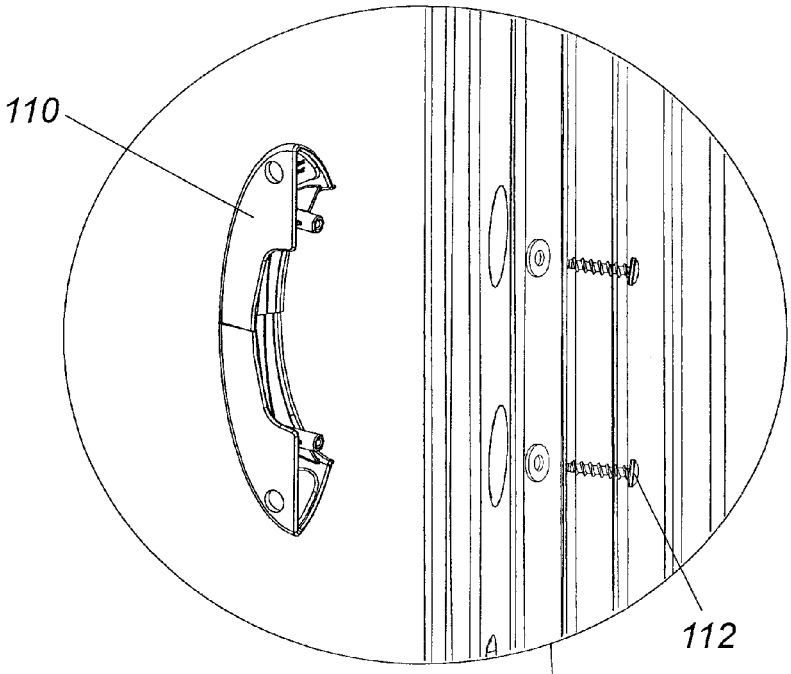
FIG. 34B is a view of the handle to door connection.
Figure 34A:
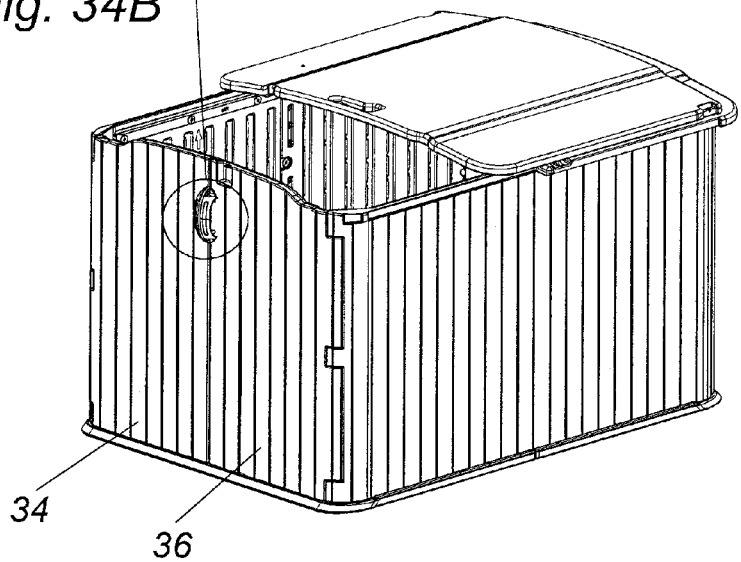
FIG. 34A is a view of the handles installed on the doors of the enclosure.
Figure 35:
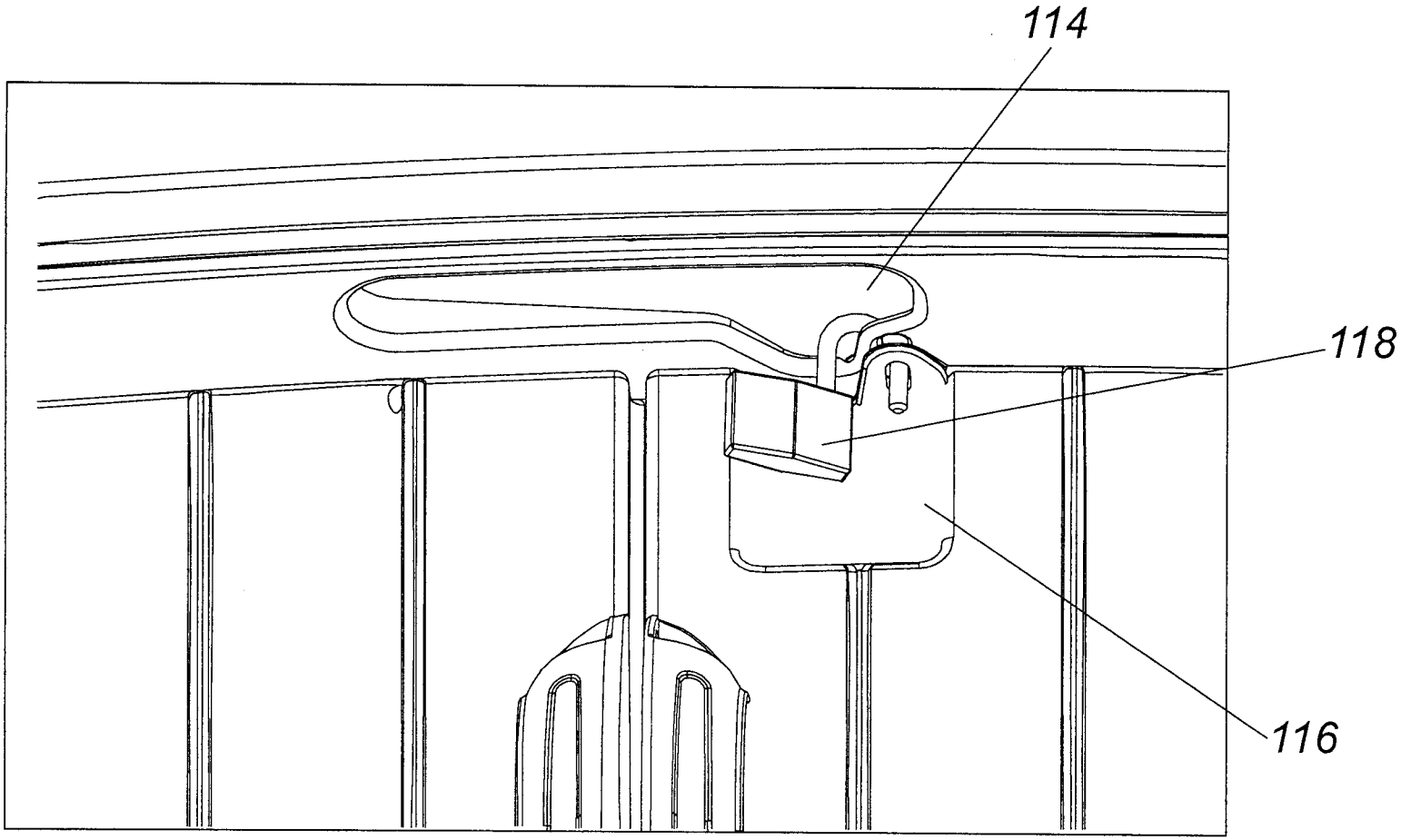
FIG. 35 is a view of a lock used to secure the enclosure closed.

FIGS. 29-32 illustrated the manner in which the left door panel 34 is installed on the enclosure. The left side wall front panel 30 includes at least three connectors 90, 92 and 94 which function as hinges. These connectors, 90-94, operatively cooperate with pins 96, 98, and 100 on the left door panel 34 to allow the left door panel to be moved from a closed position to an open position and back again. Pin 96 is secured in connector 90 using a securing member 102 (FIG. 30 A). A fastener 104 secures the securing member 102 to the left side wall front panel 30. Pins 98 are slid into connector 92 and frictionally held therein. Pin 100 is secured in connector 94 using a securing member 106 (FIGS. 31A-C and 32A). Fasteners 108 secure the securing member 106 to the left side wall front panel 30 and the floor 38 (FIG. 32 B). The right door panel 36 is secured to the right side wall front panel 26 and the floor panel 38 in the same manner as of the left door panel 34. A plurality of handles 110 are secured to the upper portions of door panels 34 and 36 using fasteners 112, as illustrated in FIGS. 34A and B. A securing or locking element 114 is provided on the front roof panel 42 (FIG. 35). A securing or locking element 116 is provided on the right door panel 36 (FIG. 35). A lock 118 can securely connect elements 114 and 116 together, thus preventing unauthorized entry into the enclosure 10.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A modular utility shed construction system utilizing molded plastic structural panels comprising:

a floor for enclosing a bottom of said utility shed, said floor including a plurality of like-configured floor panels, one of said floor panel members including a first lip extending along a longitudinal edge of said floor panel, another of said floor panel members including a second lip extending along a longitudinal edge of said another floor panel member, said second lip of said another floor panel member engaging said first lip of said one floor panel member thereby securing said one floor panel member to said another floor panel member, by engagement of a plurality of sockets located around a perimeter of said floor;

a right side wall for enclosing a right side of said utility shed, a left side wall for enclosing a left side of said utility shed, said right side wall including a front panel and a rear panel, said right side wall front and rear panels being secured together in a coplanar relationship, said left side wall including a front panel and a rear panel, said left side wall front and rear panels being secured together in a coplanar relationship;

at least three bosses along a lower edge of each of said right side wall front and rear panels and said left side wall front and rear panels, said bosses being a contoured key member of a substantially conjugate shape as said sockets, said bosses being constructed and arranged to fit into said plurality of sockets located on said floor when said right side wall and said left side wall are secured to said floor, said bosses constructed and arranged to slide transversely in relation to said sockets, whereby this motion interlocks said bosses into said corresponding sockets, said bosses locking said right and left side walls to said floor;

a rear wall for enclosing a rear portion of said utility shed, said rear wall including a rear wall panel, at least two bosses along a lower edge of said rear wall panel, said bosses being constructed and arranged to fit into said plurality of sockets located on said floor, said bosses locking said rear wall panel to said floor and preventing removal of said rear wall panel from said floor;

a roof for enclosing an upper portion of said utility shed, said roof including a plurality of roof panels secured to said left side wall, said right side wall and said rear wall to form said roof, said roof panels include a front roof panel and a back roof panel, said back roof panel is fixedly secured to said utility shed, said front roof panel is slidably secured to said utility shed, said front roof panel being slidable between a forward, closed position and a rearward, open position, said rearward position permitting ready access to said utility shed by an individual who is taller than the height of said utility shed;

a plurality of roof guides secured to said right side wall and said left side wall, said rear roof panel fixedly secured to said plurality of roof guides; and a plurality of doors enclosing a front of said utility shed and permitting access to said utility shed, said doors including at least two door panels.

2. The modular utility shed construction system of claim 1 wherein said right side wall rear panel and said left side wall rear panel each include a vertically curved portion, said vertically curved portions are secured to said rear wall panel thereby forming a smooth transition between said left and right side wall panels and said rear wall panel.

3. The modular utility shed construction system of claim 1 wherein said right side wall front panel is releasably secured to said right side wall rear panel and said left side wall front panel is releasably secured to said left side wall rear panel.

4. The modular utility shed construction system of claim 1 wherein said front roof panel and said rear roof panel are each convexly curved along a traverse section thereof.

5. The modular utility shed construction system of claim 1 including a plurality of inner roof guides, at least one said inner roof guide secured to each side of said front roof panel, said inner roof guides being slidably secured to said roof guides thereby permitting said front roof panel to move between a forward closed position and a rearward open position.

6. The modular utility shed construction system of claim 5 including a roof support secured to said roof guides, said roof support secured to and supporting said rear roof panel.

7. The modular utility shed construction system of claim 1 wherein said doors include a left door panel and a right door panel, said left door panel is hingedly secured to said left side wall front panel, said right door panel is hingedly secured to said right side wall front panel.

8. The modular utility shed construction system of claim 7 wherein said left door panel includes a plurality of pins, said left side wall front panel includes a plurality of connectors, said pins being operatively connected to said connectors thereby permitting said left door to pivot between an open position and a closed position.

9. The modular utility shed construction system of claim 8 including a first securing member securing said pins to said connector at an upper portion of both said left door and said left side wall front panel, a second securing member securing said pins to said connector at a lower portion of both said left door and said left side wall front panel.

10. The modular utility shed construction system of claim 9 including a third securing member securing said pins to said connector at an upper portion of both said right door and said right side wall front panel, a fourth securing member securing said pins to said connector at a lower portion of both said right door and said right side wall front panel.

11. The modular utility shed construction system of claim 7 wherein said right door panel includes a plurality of pins, said right side wall front panel includes a plurality of connectors, said pins being operatively connected to said connectors thereby permitting said right door to pivot between an open position and a closed position.

12. The modular utility shed construction system of claim 7 including a handle secured to each said right door panel and said left door panel, said handles permitting said left and said right door panels to be moved between an open position and a closed position.

13. The modular utility shed construction system of claim 7 including a first securing element on said front roof panel, a second securing element on one of said left or right door panels, a lock secured between said first and said second securing elements, thereby securing said modular utility shed in a locked and secure condition.

14. The modular utility shed construction system of claim 1 including at least one first groove on each side at a rear portion of said front roof panel;

at least one second groove on each side at a front portion of said rear roof panel; and a clip operatively connected between said first and said second grooves, whereby said front roof panel is secured to said rear roof panel when said roof panels are in a closed position.

15. The modular utility shed construction system of claim 14 including a plurality of inner roof guides, at least one said inner roof guide secured to each side of said front roof panel, said inner roof guides being slidably secured to said roof guides thereby permitting said front roof panel to move between a forward closed position and a rearward open position; and a roof support secured to said roof guides, said roof support secured to and supporting said rear roof panel.

* * * * *